US007896966B2

(12) United States Patent
Masuyama et al.

(10) Patent No.: US 7,896,966 B2
(45) Date of Patent: Mar. 1, 2011

(54) LIQUID APPLYING APPARATUS AND INK-JET PRINTING APPARATUS

(75) Inventors: Atsuhiko Masuyama, Yokohama (JP); Osamu Iwasaki, Tokyo (JP); Yoshinori Nakagawa, Kawasaki (JP); Naomi Oshio, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1087 days.

(21) Appl. No.: 11/621,346

(22) Filed: Jan. 9, 2007

(65) Prior Publication Data

US 2007/0101936 A1 May 10, 2007

Related U.S. Application Data

(63) Continuation of application No. PCT/JP2006/315960, filed on Aug. 11, 2006.

(30) Foreign Application Priority Data

Aug. 15, 2005 (JP) ..... 2005-235407

(51) Int. Cl.
*B05C 1/02* (2006.01)

(52) U.S. Cl. ..... 118/600; 118/602; 118/249; 118/256; 118/259; 118/262; 118/300; 118/304; 347/84; 347/85; 347/101; 347/103

(58) Field of Classification Search ..... 118/46, 118/249, 256, 259, 261, 262, 663, 708, 712, 118/206, 600, 602, 692, 694, 300, 304; 347/84, 347/85, 101, 103; 101/416.1, 423, 424.2, 101/147, 148; 427/428.13, 428.2, 428.21
See application file for complete search history.

(56) References Cited

U.S. PATENT DOCUMENTS 6,183,079 B1 * 2/2001 Meade et al. ..... 347/101
2002/0023561 A1 * 2/2002 Leimand ..... 101/366
2005/0179720 A1 8/2005 Iwasaki et al.
2006/0176325 A1 8/2006 Seki et al.
2007/0034102 A1 2/2007 Oshio et al.
2007/0034152 A1 2/2007 Nakagawa et al.
2007/0035592 A1 2/2007 Oshio et al.
2007/0035593 A1 2/2007 Iwasaki et al.
2007/0070163 A1 3/2007 Masuyama et al.

(Continued)

FOREIGN PATENT DOCUMENTS

EP 1 564 009 8/2005

(Continued)

*Primary Examiner*—Laura Edwards
(74) *Attorney, Agent, or Firm*—Fitzpatrick, Cella, Harper & Scinto

(57) ABSTRACT

An applying amount to an applying medium is controlled in a liquid applying apparatus. Specifically, before driving a pump, a circulation speed decision processing (S3) is carried out. According to this decided speed, a speed of the circulation flow generated in a liquid holding space is controlled in a pump operating process (S4). This controls a pressure in the liquid holding space. As a result, a state of flow of the applying liquid at a contact member of a liquid holding member in contact with the applying roller is changed, and an amount of the applying liquid adhering to an applying roller and going out of the contact portion is controlled. This can control the amount of the applying liquid to be applied to the applying medium.

6 Claims, 23 Drawing Sheets

U.S. PATENT DOCUMENTS

| | | | |
|---|---|---|---|
| 2007/0126835 | A1 | 6/2007 | Oshio et al. |
| 2007/0126836 | A1 | 6/2007 | Masuyama et al. |

FOREIGN PATENT DOCUMENTS

| | | |
|---|---|---|
| EP | 1 564 010 | 8/2005 |
| EP | 1 564 011 | 8/2005 |
| JP | 8-58069 | 3/1996 |
| JP | 10-128204 | 5/1998 |
| JP | 10-309512 | 11/1998 |
| JP | 11-42454 | 2/1999 |
| JP | 2002-96452 | 4/2002 |
| JP | 2002-248395 | 9/2002 |
| JP | 2004-313955 | 11/2004 |
| JP | 2005-047198 | 2/2005 |

* cited by examiner

| | | | | | | | | |
|---|---|---|---|---|---|---|---|---|
| TEMPERATURE | High | High | High | High | Low | Low | Low | Low |
| PAPER TYPE | Rough | Smooth | Rough | Smooth | Rough | Smooth | Rough | Smooth |
| GRADE | High | High | Low | Low | High | High | Low | Low |
| | ↓ | ↓ | ↓ | ↓ | ↓ | ↓ | ↓ | ↓ |
| PUMP SPEED | A | B | C | D | E | F | G | H |

FIG.19

LIQUID APPLYING APPARATUS AND INK-JET PRINTING APPARATUS

This application is a continuation of Internatonal Application No. PCT/JP/2006/315960, filed on Aug. 11, 2006.

TECHNICAL FIELD

The present invention relates to a liquid applying apparatus and an ink-jet printing apparatus, and more specifically to a liquid applying apparatus for applying a liquid with a predetermined purpose such as accelerating aggregation of a pigment at printing with an ink having the pigment as a color material. Particularly, the present invention relates to control of an applying amount of the liquid to a medium.

BACKGROUND ART

As this type of applying apparatus, an apparatus is known with which a liquid to be applied is supplied to an applying member such as a roller, which applies the supplied liquid to a medium. Among the applying apparatuses using such type of an applying member, a construction to seal a portion which supplies or applies an applying liquid to a roller is described in Patent Document 1. The applying mechanism described in the document is a mechanism for applying an ink to a roller with a pattern of a printing plate formed on the surface thereof in a gravure printing device. In this mechanism, an ink chamber which has doctor blades extending in the longitudinal direction of the roller at positions corresponding to upper and lower two locations along the circumferential surface of the roller as well as elastic members provided on both sides of these two doctor blades, respectively, is used. By bringing this chamber into contact with the circumferential surface of the roller, a liquid chamber is defined by the chamber and the roller. And when the roller rotates, the applying liquid in this liquid chamber is supplied or applied to the roller.

This construction to supply a liquid while the chamber holding the liquid is brought into contact with the roller, has an advantage such as preventing leakage of the liquid. Particularly, in an ink-jet printing apparatus such as a printer provided with an applying mechanism, leakage of the applying liquid caused by attitude change during transportation can be prevented, and a printer that can be adapted to transportation can be realized.

The patent document 1: Japanese Patent Application Laid-open No. 08-58069

DISCLOSURE OF THE INVENTION

The applying mechanism disclosed in Patent Document 1 is a mechanism in which the chamber holding the liquid is brought into contact with the roller, and at that contact portion the liquid adheres onto the roller, is transported thereon and transferred to a medium with rotation of the roller. Therefore, the adhesion amount on the roller might change depending on the state of the above contact with the liquid or the state of the contact portion.

For example, when the viscosity of the liquid is changed, the state of the flow (movement) of the liquid at the contact portion is changed, so that the amount of the liquid which can adhere to the roller and go out of the above contact portion is changed. As described above, if factors are caused which changes the contact state between the liquid holding member such as the chamber and the applying member such as the roller, the amount of liquid adhering to the applying member and going out of this contact portion is changed and the amount to be finally transferred (applied) to the medium is also changed. It is preferable that such unintended change of applying amount is reduced as mach as possible.

The present invention was made in view of the above points and has a purpose to provide a liquid applying apparatus and an ink-jet printing apparatus which can reduce an unintended change of an applying amount.

To achieve the above object, there is provided a liquid applying apparatus comprising: liquid applying means that includes an applying member for applying a liquid to an applying medium and a liquid holding member which contacts with said applying member to form a liquid holding space for holding the liquid in the liquid holding space, and that moves said applying member relatively to the applying medium to apply the liquid in the liquid holding space to the applying medium through said applying member; and control means for controlling an amount of the liquid applied by said liquid applying means.

In another aspect of the present invention, there is provided a liquid applying apparatus comprising: a liquid applying unit that includes an applying roller for applying a liquid to an applying medium and a liquid holding member which contacts with said applying roller to form a liquid holding space for holding the liquid in the liquid holding space, and that rotates said applying roller to apply the liquid in the liquid holding space to the applying medium through said applying roller; and control means for changing a speed of a liquid flow in the liquid holding space to control an amount of the liquid applied through said liquid applying roller.

In further aspect of the present invention, there is provided a liquid applying apparatus comprising: a liquid applying unit that includes an applying member for applying a liquid to an applying medium and a liquid holding member which contacts with said applying member to form a liquid holding space for holding the liquid in the liquid holding space, and that moves said applying member relatively to the applying medium to apply the liquid in the liquid holding space to the applying medium through said applying member; and control means for changing pressure in the liquid holding space to control an amount of the liquid applied through said liquid applying member.

In still further aspect of the present invention, there is provided a liquid applying apparatus comprising: a liquid applying unit that includes an applying roller for applying a liquid to an applying medium and a liquid holding member which contacts with said applying roller to form a liquid holding space for holding the liquid in the liquid holding space, and that rotates said applying roller to apply the liquid in the liquid holding space to the applying medium through said applying roller; and control means for changing a rotational speed of said applying roller to control an amount of the liquid applied through said liquid applying roller.

In still further aspect of the present invention, there is provided a liquid applying apparatus comprising: a liquid applying unit that includes an applying member for applying a liquid to an applying medium and a liquid holding member which contacts with said applying member to form a liquid holding space for holding the liquid in the liquid holding space, and that moves said applying member relatively to the applying medium to apply the liquid in the liquid holding space to the applying medium through said applying member; a storage portion for storing the liquid; a supply path for supplying the liquid from said storage portion to the liquid holding space; a recovery path for recovering the liquid from the liquid holding space to said storage portion; circulation means for circulating the liquid in a flow path including said storage portion, said supply path, the liquid holding space and said recovery path; and control means for changing a circulation speed of the liquid circulated by said circulation means to control an amount of the liquid applied.

In still further aspect of the present invention, there is provided a liquid applying apparatus comprising: a liquid applying unit that includes an applying roller for applying a liquid to an applying medium and a liquid holding member which contacts with said applying roller to form a liquid holding space for holding the liquid in the liquid holding space, and that rotates said applying roller to apply the liquid in the liquid holding space to the applying medium through said applying roller; and control means for changing a contact force between said applying roller and said liquid holding member to control an amount of the liquid applied through said liquid applying roller.

Furthermore, there is provided an ink jet printing apparatus comprising: any one of liquid applying apparatuses stated above; and printing means for printing an image on the medium by ejecting ink to the medium, to which the liquid is applied in said liquid applying apparatus.

According to the above construction, when applying a liquid in a liquid holding space to an applying medium through an applying member (for example, applying roller), the amount of the liquid to be applied to the applying medium can be controlled. For example, pressure of the liquid or a flow velocity of the liquid in the liquid holding space is changed so as to adjust the applying amount.

Further features of the present invention will become apparent from the following description of exemplary embodiments (with reference to the attached drawings).

BRIEF DESCRIPTION OF THE DRAWINGS

FIG. 19 is a table used for circulation speed decision processing according to an embodiment of the present invention;

BEST MODE FOR CARRYING OUT THE INVENTION

Figure 1:
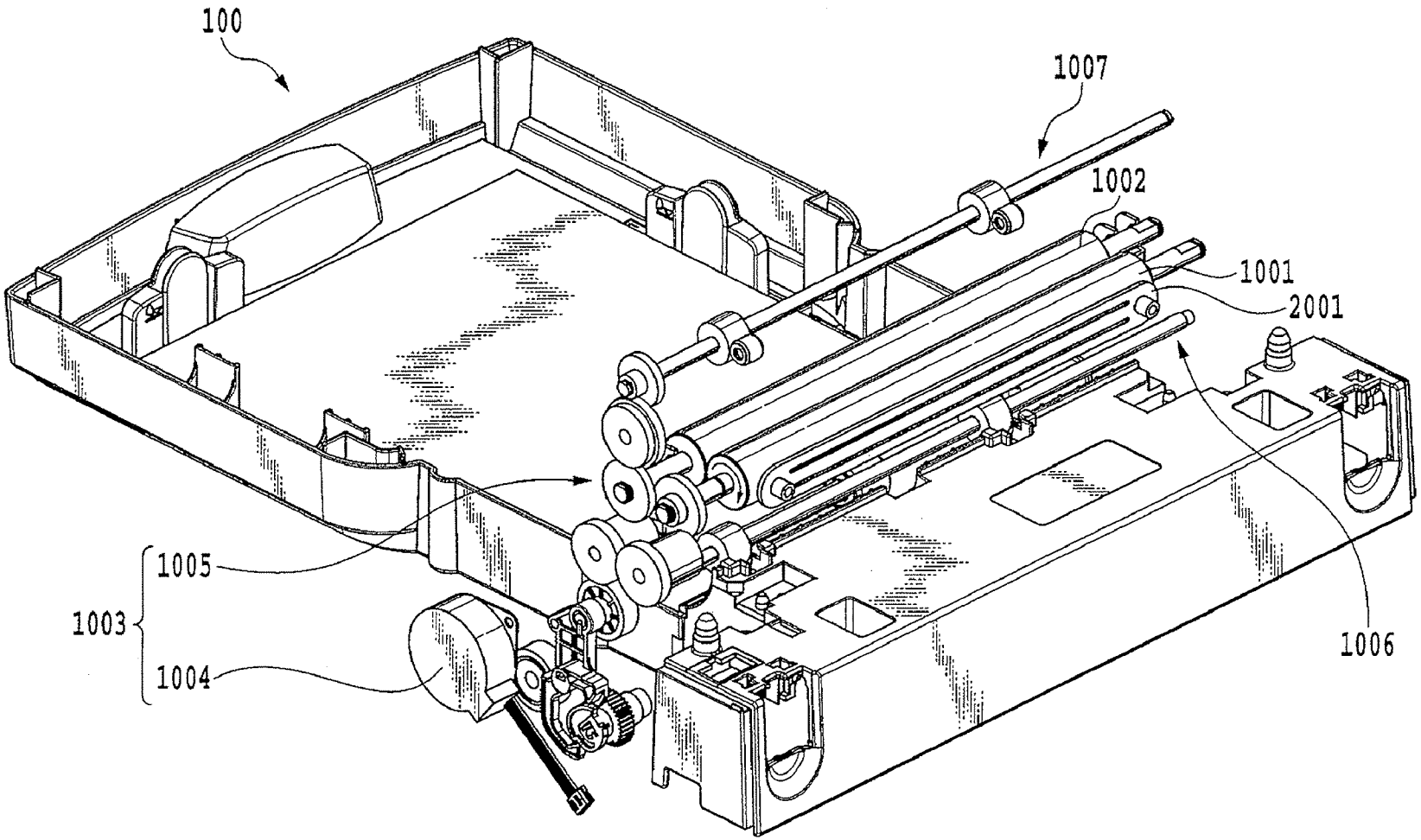
FIG. 1 shows an outline construction of a liquid applying apparatus in an embodiment of the present invention.

Embodiments of the present invention will be described in detail referring to the drawings.

First Embodiment

FIG. 1 is a perspective view showing an entire configuration of an embodiment of a liquid applying apparatus 100 according to the present invention. The liquid applying apparatus 100 shown herein is roughly configured to have a liquid applying mechanism for applying a predetermined applying liquid (also referred to as applying liquid hereinafter) to an applying medium (also referred to as applying medium hereinafter) and a liquid supplying mechanism for supplying the applying liquid to the liquid applying mechanism.

The liquid applying mechanism has a cylindrical applying roller (also referred to as applying roller hereinafter) 1001, a cylindrical counter roller (medium support member) 1002 arranged opposite to the applying roller 1001, and a roller driving mechanism 1003 for driving the applying roller 1001, or the like. The roller driving mechanism 1003 is composed of a roller driving motor 1004 and a power transmission mechanism 1005 having a gear train for transmitting a driving force of this roller driving motor 1004 to the applying roller 1001.

Moreover, the liquid supplying mechanism is configured by having a liquid holding member 2001 for holding an applying liquid between itself and the circumferential surface of the applying roller 1001, and a liquid flow path 3000 (not shown in FIG. 1), which will be described later, for supplying the liquid to the liquid holding member 2001. The applying roller 1001 and the counter roller 1002 are rotatably supported by shafts in parallel with each other, which respective both ends are rotatably mounted to a frame, not shown. Moreover, the liquid holding member 2001 extends over substantially the whole length of the applying roller 1001 in the longitudinal direction and is movably mounted to the above frame via a mechanism capable of approach/separation with respect to the circumferential surface of the applying roller 1001.

The liquid applying apparatus of the embodiment is further provided with an applying medium supplying mechanism 1006 composed of a pickup roller and the like for conveying the applying medium to a nip portion between the applying roller 1001 and the counter roller 1002. Moreover, in a conveying path of the applying medium, a paper discharge mechanism 1007 composed of a paper discharge roller and the like for conveying the applying medium on which the applying liquid has been applied to a paper discharge portion (not shown) is provided on the down stream side of the applying roller 1001 and the counter roller 1002. These paper feed mechanism and paper discharge mechanism are operated by a driving force of the driving motor 1004 transmitted via the power transmission mechanism 1005 as well as the applying roller or the like.

The applying liquid used in the embodiment is a liquid for promoting an aggregation of a pigment when printing is performed with ink having the pigment as color material. An example of components of the applying liquid is described below:

Calcium nitrate tetrahydrate: 10%

Glycerin: 42%

Surfactant: 1%

Water: remaining amount

The viscosity of the above applying liquid is 5 to 6 cP (centipoise) at 25° C.

It is needless to say that the applying liquid in application of the present invention is not limited to the above. For example, a liquid containing a component to insolubilize or coagulate a dye can be used as another applying liquid. Alternatively, a liquid containing a component to suppress curl (phenomenon that the medium is brought into a curved shape) of the applying medium can also be used as another applying liquid.

When water is used in a liquid to be applied, slidability between the applying roller and the contact portion of the liquid holding member is made better by adding a component to lower surface tension to the liquid. In the above example of components of the applying liquid, glycerin and surfactant are components to lower the surface tension of water.

Next, components of each portion configuring the liquid applying apparatus roughly described above will be explained in detail.

Figure 2:
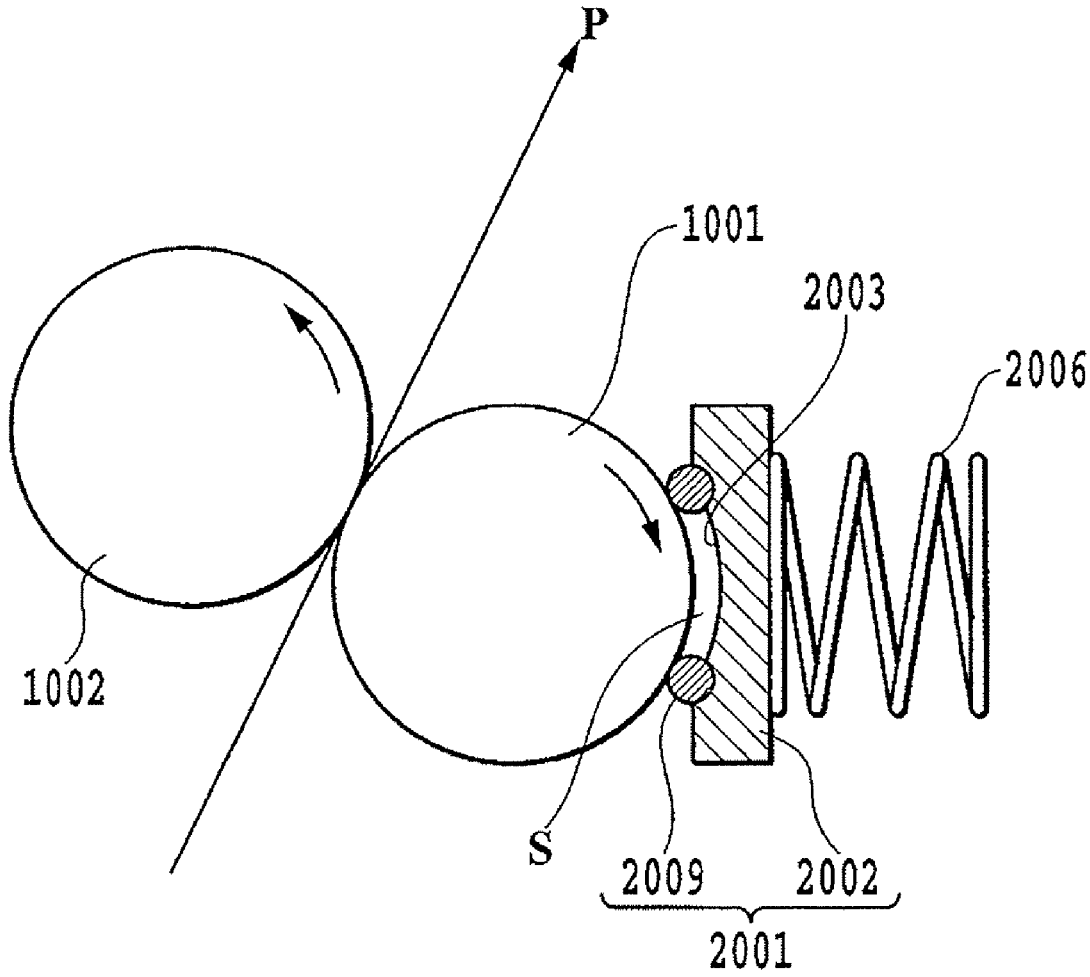
FIG. 2 is a longitudinal sectional side view showing an example of arrangement of an applying roller, a counter roller, a liquid holding member and the like shown in FIG. 1.

FIG. 2 is a side sectional view showing a detail arrangement of the applying roller 1001, the counter roller 1002 and the liquid holding member 2001. The counter roller 1002 is biased toward the circumferential surface of the applying roller 1001 by a biasing mechanism, not shown, configured by having a spring or the like. By rotating the applying roller 1001 clockwise in this state in the figure, a printing medium P to which the applying liquid is to be applied can be held between the both rollers and can be conveyed in the arrow direction in the figure. In this embodiment, the material of the applying roller 1001 is a silicon having rubber hardness of 40 degrees, with the surface roughness of Ra 1.6 um and the diameter of 23.169 mm. The material of the counter roller 1002 is a steel material with a diameter of 14 mm.

When the liquid holding is biased toward the circumferential surface of the applying roller 1001 by the biasing force of the spring (pressing means) 2006, to be brought into contact with the applying roller, a long liquid holding space S extending over the whole liquid applying area by the applying roller 1001 is formed. In this liquid holding space S, the applying liquid is supplied from a liquid flow path 3000, which will be described later, via the supply port of the liquid holding member 2001. In this case, since the liquid holding member 2001 is configured as follows, unintentional leakage of the applying liquid from the liquid holding space S to the outside can be prevented or decreased while the applying roller 1001 is stopped.

Figure 3:
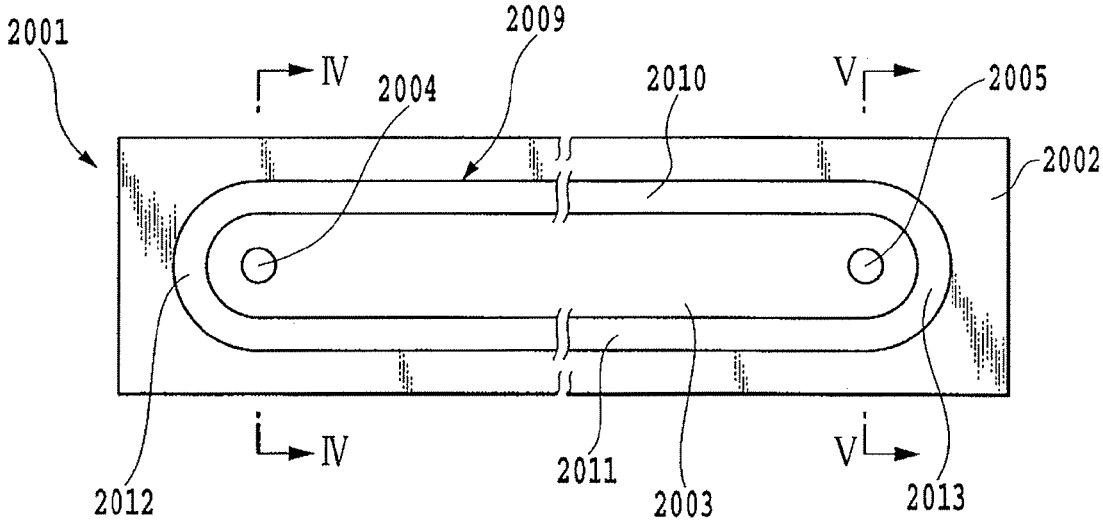
FIG. 3 is a front view of the liquid holding member shown in FIGS. 1 and 2.

A configuration of the liquid holding member 2001 is shown in FIGS. 3 to 8. As shown in FIG. 3, the liquid holding member 2001 is configured to have the space forming member 2002 and the annular contact member 2009 provided on the surface of the space forming member 2002. In the space forming member 2002, a recess portion 2003 cross section profile of which has an arc is formed along the longitudinal direction at the center. The contact member 2009 has straight portions 2010, 2011 which are fixed along the respective straight edge portions of the recess portion 2003, and circumference portions 2012, 2013 which are fixed in a state that each of the portions 2012, 2013 extends from upper one of the edge portions through the recess portion to the similar straight edge portion on the opposite side. By this configuration, when the contact potion 2009 of the liquid holding member 2001 is brought into contact with the applying roller 1001, contact along the circumferential surface shape of the applying roller is made possible, which can realize contact with a uniform pressure.

As described above, the contact member 2009 of the liquid holding member in this embodiment is formed integrally without seams and thus is brought into contact with the outer circumferential surface of the applying roller 1001 continuously without a gap by the biasing force of the spring member 2006. As a result, the liquid holding space S becomes a space substantially blocked by the contact member 2009, one surface of the space forming member and the outer circumferential surface of the applying roller 1001 and the applying liquid is held in this space. In the state where rotation of the applying roller 1001 is stopped, the contact member 2009 and the outer circumferential surface of the applying roller 1001 maintain a liquid tight state, by which leakage of the liquid to the outside can be surely prevented. On the other hand, when the applying roller 1001 is rotated, as will be described later, the applying liquid passes between the outer circumferential surface of the applying roller 1001 and the contact member 2009 and adheres to the outer circumferential surface of the applying roller in a layered state. As described in FIG. 13 or later, an embodiment of the present invention controls an amount of the applying liquid adhered to the outer circumferential surface of the applying roller.

Here, the close contact state between the outer circumferential surface and the contact member 2009 when the applying roller 1001 is stopped means that, as mentioned above, a liquid is prevented from passing between the inside and the outside of the above liquid holding space S. In this case, the contact state of the contact member 2009 is such that the contact member is in direct contact with the outer circumferential surface of the applying roller 1001 and also includes a state that the contact member is brought into contact with the above outer circumferential surface through a liquid film formed by a capillary force.

Figure 6:
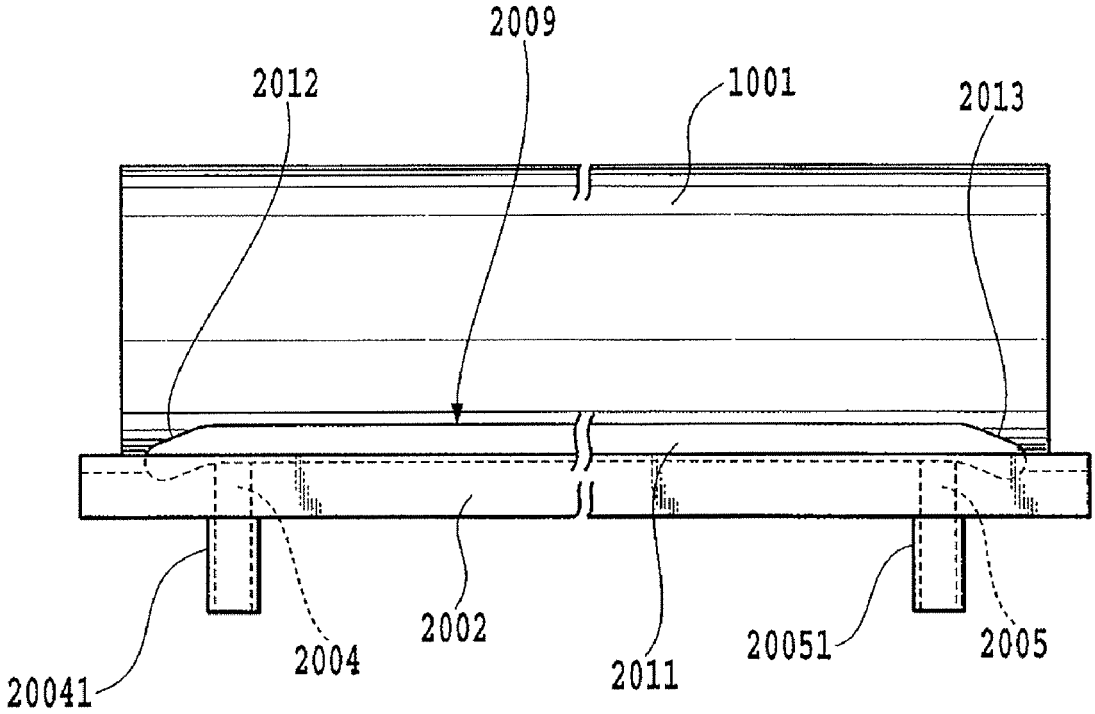
FIG. 6 is a plan view of the liquid holding member shown in FIG. 3.
Figure 7:
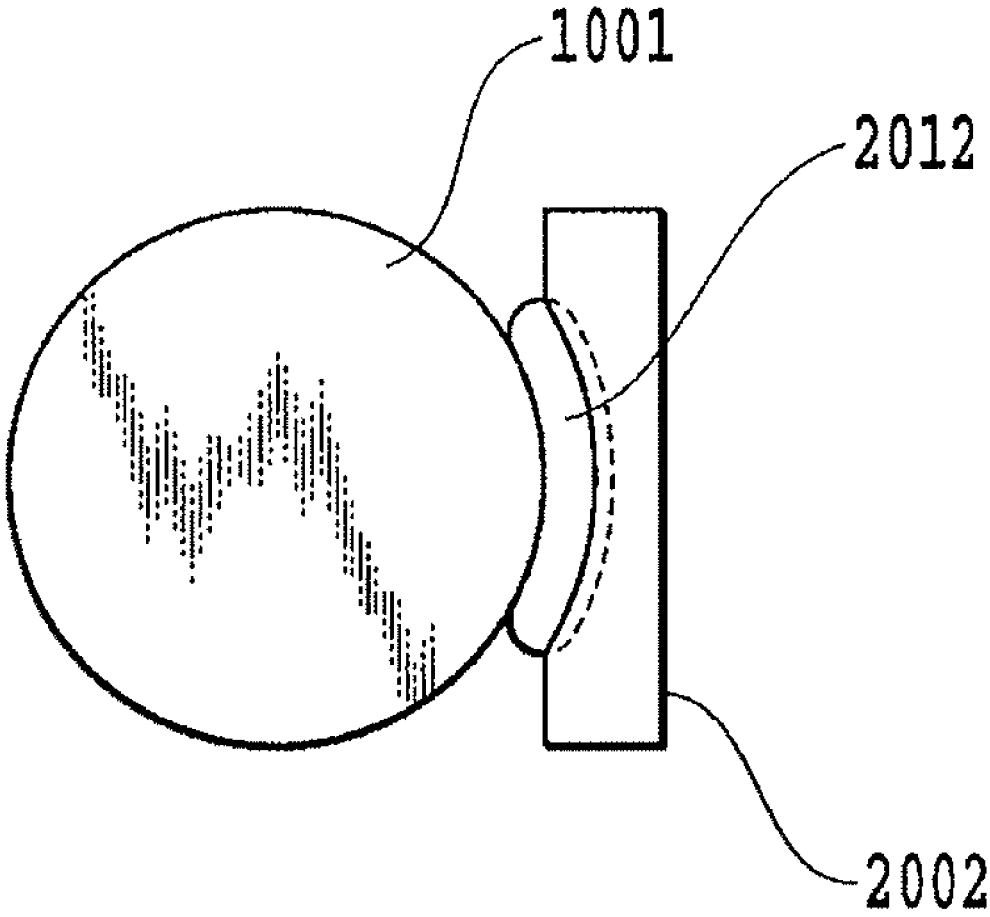
FIG. 7 is a left side view showing a state where a contact portion of the liquid applying member shown in FIG. 3 is brought into contact with a liquid applying roller.
Figure 8:
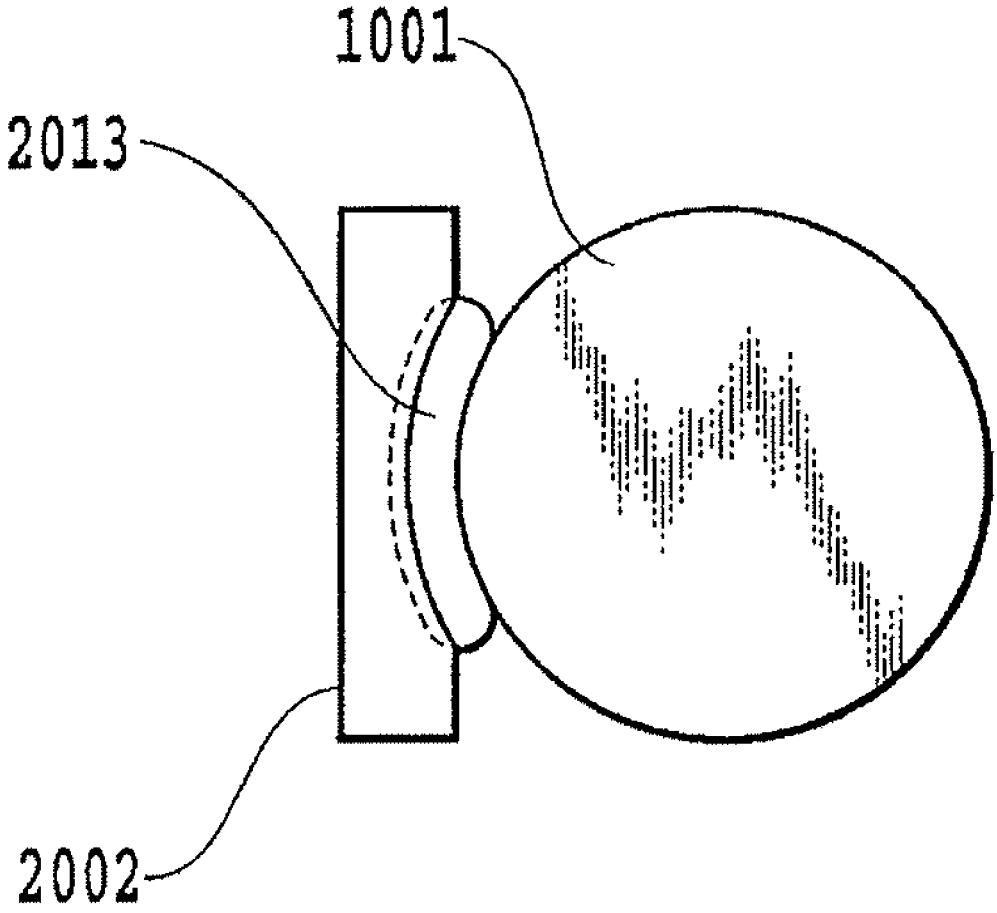
FIG. 8 is a right side view showing a state where a contact portion of the liquid applying member shown in FIG. 3 is brought into contact with a liquid applying roller.

Moreover, both right and left side portions 2012, 2013 in the longitudinal direction of the contact member 2009 form a slowly curved shape seen from any direction of front (FIG. 3), plane (FIG. 6) and sides (FIGS. 7, 8). Therefore, even if the contact member 2009 is brought into contact with the applying roller 1001 with a relatively large pressing force, the entire contact member 2009 is elastically deformed substantially uniformly, and a large local distortion is not generated. Therefore, the contact member 2009 is brought into contact with the outer circumferential surface of the applying roller 1001 continuously without a gap as shown in FIGS. 6 to 8, and the above substantially blocked space can be formed.

Figure 4:
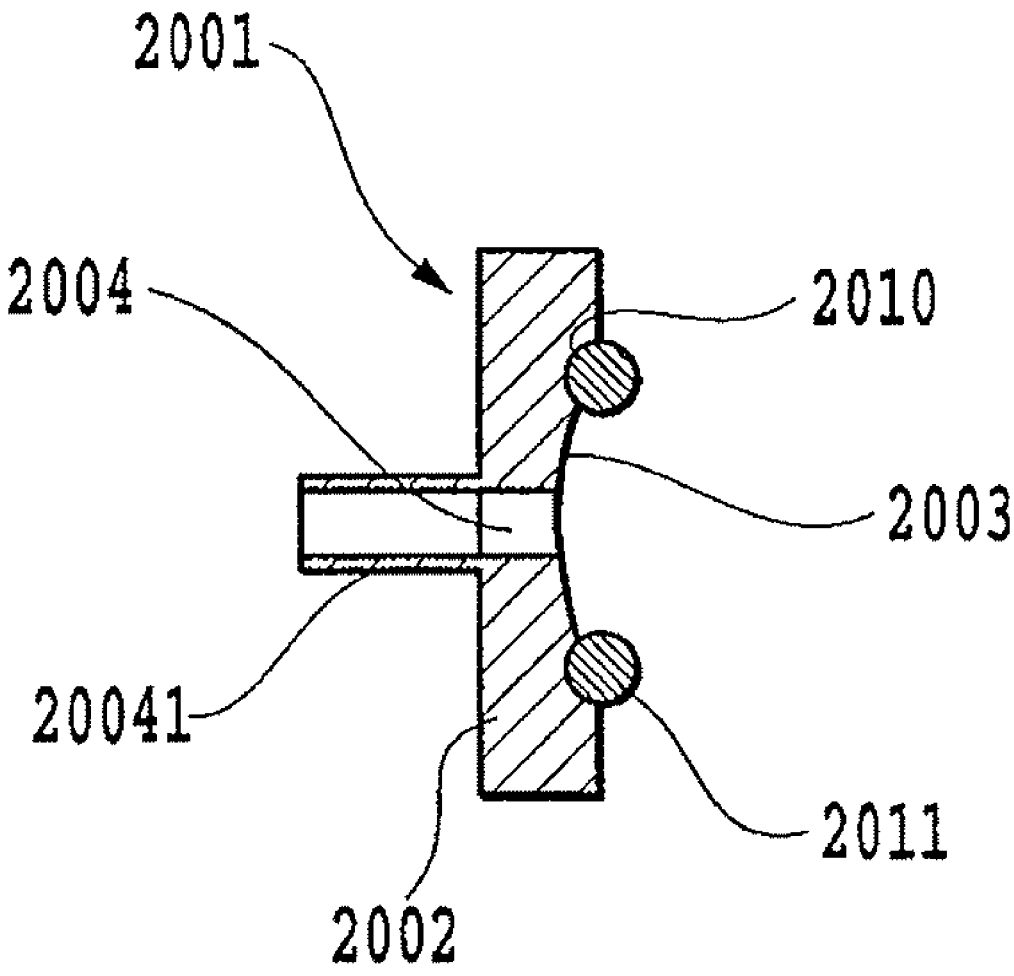
FIG. 4 is an end face view showing an end face where the liquid holding member shown in FIG. 3 is cut at IV-IV line.
Figure 5:
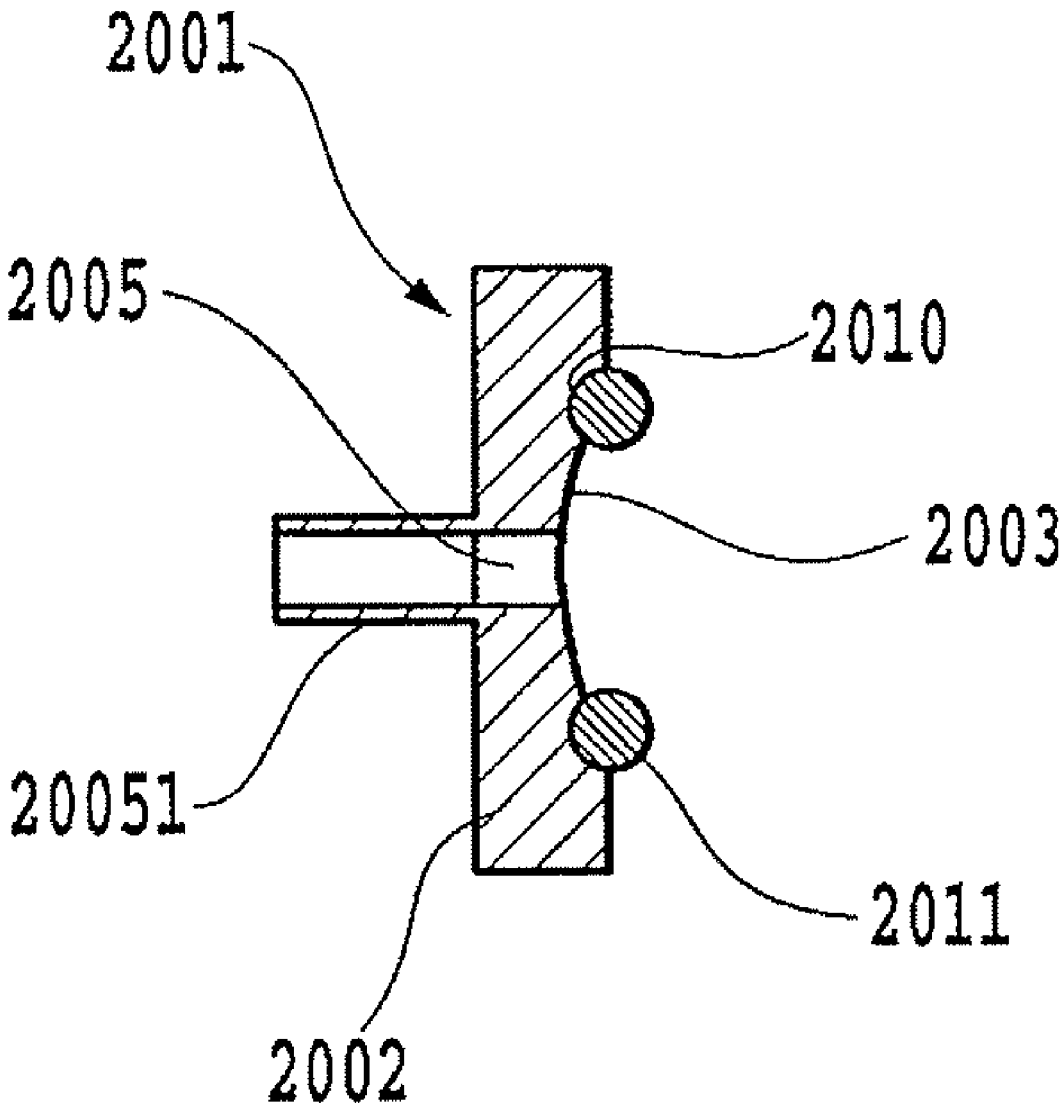
FIG. 5 is an end face view showing an end face where the liquid holding member shown in FIG. 3 is cut at V-V line.

A liquid supply port 2004 and a liquid recovery port 2005 having a hole piercing the space forming member 2002, respectively, are provided in an area surrounded by the contact member 2009 in the space forming member 2002 as shown in FIGS. 3 to 5. These ports communicate with cylindrical connection portions 20041, 20051 projected on the back surface side of the space forming member. These connection portions 20041, 20051 are connected to a liquid supply flow path 3000, which will be described later. In this embodiment, the liquid supply port 2004 is formed in the vicinity of one end portion (left end portion in FIG. 3) of the area surrounded by the contact member 2009, while the liquid recovery port 2005 is provided in the vicinity of the other end portion (right end portion in FIG. 3) of the same area. The liquid supply port 2004 supplies the applying liquid supplied from the liquid flow path 3000 to the above-mentioned liquid holding space S, while the liquid recovery port 2005 flows out the liquid in the liquid holding space S into the liquid flow path 3000. By this supply/flow-out of the liquid, the applying liquid flows from the above-mentioned left end portion to the right end portion in the liquid holding space S.

(Applying Liquid Flow Path)

Figure 11:
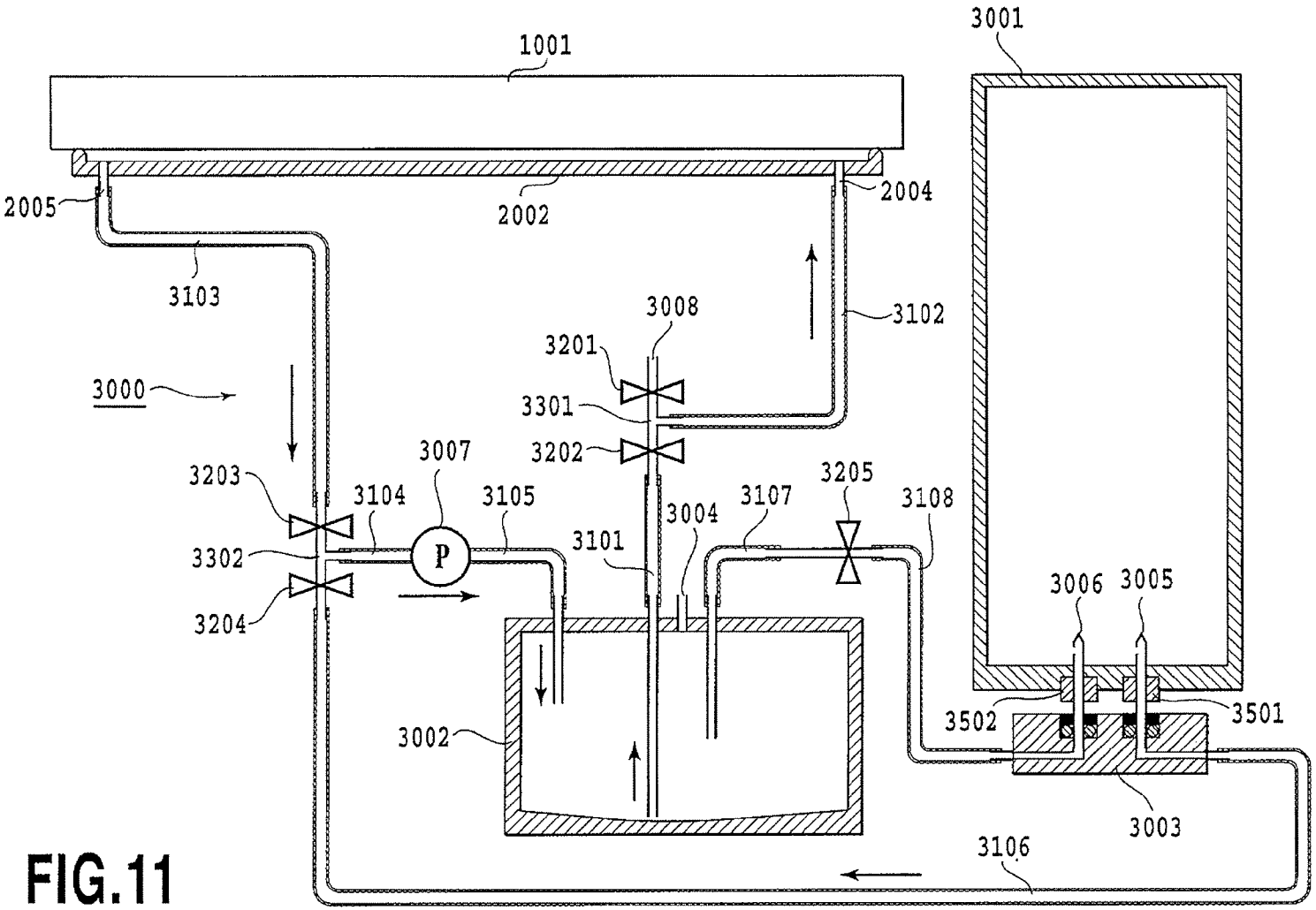
FIG. 11 shows a flow path construction of a liquid applying apparatus according to an embodiment of the present invention.

FIG. 11 is a diagram showing an outline construction of a liquid flow path 3000 connected to the liquid holding member 2001 for supplying an applying liquid to the liquid holding member and for recovering the applying liquid from the liquid holding member.

The liquid flow path 3000 is provided with a tube 3101 and a tube 3102 constituting a first flow path (supply flow path) connecting a liquid supply port 2004 of a space forming member 2002 constituting the liquid holding member 2001 to a buffer tank 3002 for storing the applying liquid. Moreover, the liquid flow path 3000 is provided with tubes 3103, 3104 and 3105 constituting a second flow path (recovery flow path) which connects a liquid recovery port 2005 of the space forming member 2002 to the buffer tank 3002. And the buffer tank 3002 is provided with an atmospheric air communication port 3004.

A first T-shaped flow path 3301 connecting three ports is provided between the tube 3101 and the tube 3102 constituting the first flow path. The first T-shaped flow path 3301 allows one of the connection port 3008 to communicate with the atmospheric air. Closer to the communicating port 3008 that communicates with the atmospheric air than the meeting point of the first T-shaped flow path 3301 connecting three ports, a first shut-off valve 3201 for switching communication/shutoff between the communication port 3008 and the first T-shaped flow path 3301 is provided. Moreover, the first T-shaped flow path 3301 connects to the buffer tank 3002 through the tube 3101. Closer to the connection port that is connected to the tube 3101 than the meeting point of the first T-shaped flow path connecting the three ports, a second shut-off valve 3202 for switching communication/shutoff between the tube 3101 and the first T-shaped flow path 3301 is provided. Moreover, the first T-shaped flow path 3301 connects the remaining connection port to the liquid supply port 2004 through the tube 3102. This construction of the first shut-off valve 3201, the second shut-off valve 3202 and the first T-shaped flow path 3301 allows the tube 3102 to select its connection to either the atmospheric air or the buffer tank 3002 using the combination of communication/shutoff of the two shut-off valves.

Moreover, in the second flow path which includes the tube 3103, 3104 and 3105, a pump 3007 is arranged for forcing the applying liquid and air to flow in the direction toward the buffer tank 3002 in this liquid flow path 3000. To the side of the pump 3007 into which the applying liquid flows (also referred to as an "upstream side of pump" in this specification), the tube 3104 is connected. Conversely, to the side of the pump 3007 from which the applying liquid flows out (also referred to as a "downstream side of pump" in this specification), the tube 3105 is connected. This tube 3105 connects the buffer tank 3002 to the pump 3007. The tube 3104 connects the pump 3007 to the second T-shaped flow path 3302 connecting the three ports while the tube 3103 connects the second T-shaped flow path 3302 to the liquid recovery port 2005.

By connecting the buffer tank 3002 to the space forming member 2002 through these first and second flow paths, and by driving the pump 3007, the applying liquid in the buffer tank 3002 can be supplied to the space forming member 2002 while being circulated.

Moreover, the liquid flow path 3000 is provided with a third flow path (replenishing flow path) that connects an replaceable tank 3001 for storing the applying liquid to the second flow path as well as a fourth flow path that connects the buffer tank 3002 to the replaceable tank 3001. It is to be noted that the replaceable tank 3001 is a tank with capacity larger than that of the buffer tank 3002.

A tube 3106 that is included in the third flow path is connected to the replaceable tank 3001 through a first connection port 3005 in the syringe-needle shape and a pedestal 3003 constituting a connection flow path. That is, by making the first connection port 3005 in the syringe-needle shape penetrate a rubber 3501 that is provided at the bottom portion of the replaceable tank 3001, a tube 3106 connects to the replaceable tank 3001. And the other port of the tube 3106 connects to the above second T-shaped flow path 3302. In this embodiment, the tube 3106 is a replenishing flow path for supplying the applying liquid from the replaceable tank 3001 to the buffer tank 3002.

The second T-shaped flow path 3302 is provided with a third shut-off valve 3203 capable of switching communication/shutoff between the tube 3103 and the second T-shaped flow path 3302 at a part closer to the tube 3103 than a meeting point connecting the three ports. Also, the second T-shaped flow path 3302 is provided with a fourth shut-off valve 3204 capable of switching communication/shutoff between the tube 3106 and the second T-shaped flow path 3302 at a part closer to the tube 3106 than the meeting point. With the construction of the third shutoff 3203, the fourth shut-off valve 3204 and the second T-shaped flow path 3302, the counterpart of connection with the tube 3104 can be selected from either the replaceable tank 3001 or the space forming member 2002 according to the combination of communication/shutoff of the two shut-off valves.

The fourth flow path includes tubes 3107 and 3108. The tube 3108 included in the fourth flow path is connected to the replaceable tank 3001 through the second connection port 3006 in the syringe-needle shape and the pedestal 3003 constituting the connection flow path. That is, by making the second connection port 3006 in the syringe-needle shape penetrate a rubber 3502 that is provided at the bottom portion of the replaceable tank 3001, the tube 3108 connects to the replaceable tank 3001. The replaceable tank 3001 communicates with the buffer tank 3002 through a fifth shut-off valve 3205 capable of switching communication/shutoff between the tube 3107 and the tube 3108.

It is to be noted that switching of the respective shut-off valves is carried out by a control signal from a control portion 4000, which will be described later, and thereby filling, supply, recovery and the like of the applying liquid is carried out.

Also, the positions of the second T-shaped flow path and the third and fourth shut-off valves that make the tube 3103 for recovering the applying liquid and the tube 3106 merge and that also switch between these flow paths and the tube 3104 are as follows. These positions may be arranged anywhere as long as they are between the pump 3007 and the liquid recovery port 2005. Also, as will be described later in another embodiment of the liquid flow path, the second T-shaped flow path and the third and fourth shut-off valves may be arranged between the liquid supply port 2004 and the buffer tank 3002. That is, the second T-shaped flow path and the third and fourth shut-off valves may be arranged at any position as long as they are on the upstream side of the pump 3007.

In this embodiment, on the upstream side of the pump 3007, the recovery flow path and the replenishing flow path are merged, and also switching of the connection between a flow path leading to the pump 3007 and the recovery flow path and between the flow path leading to the pump 3007 and the replenishing flow path is made. In this switching, when the recovery flow path connects to the pump 3007, the replenishing flow path does not connect to the pump 3007. Thus, during this time, circulation can be carried out in the first flow path, liquid holding space S and second flow paths, or supply/recovery of the applying liquid to the liquid holding space S can be carried out, by the pump 3007. On the other hand, when the replenishing flow path connects to the pump 3007 by the above switching, the recovery flow path does not connect to the pump 3007. Therefore, during this time, the applying liquid can be replenished from the replaceable tank 3001 to the buffer tank 3002 through the third flow path.

In this way, in this embodiment, merging and switching of the recovery flow path and the replenishing flow path are carried out on the upstream side of the pump 3007, and the flow path that is not in communication with the pump 3007 is shutoff from the pump 3007. Therefore, the control for the flow paths having the buffer tank 3002 and the replaceable tank 3001 can be carried out using a single pump.

Moreover, by controlling driving of this pump 3007, as will be described in FIG. 13 and later, the applying liquid is circulated to and from the liquid holding member 2001, and the flow velocity of the applying liquid flowing from the liquid supply port 2004 to the liquid recovery port 2005 in the liquid holding member 2001 is controlled.

(Control System)

Figure 12:
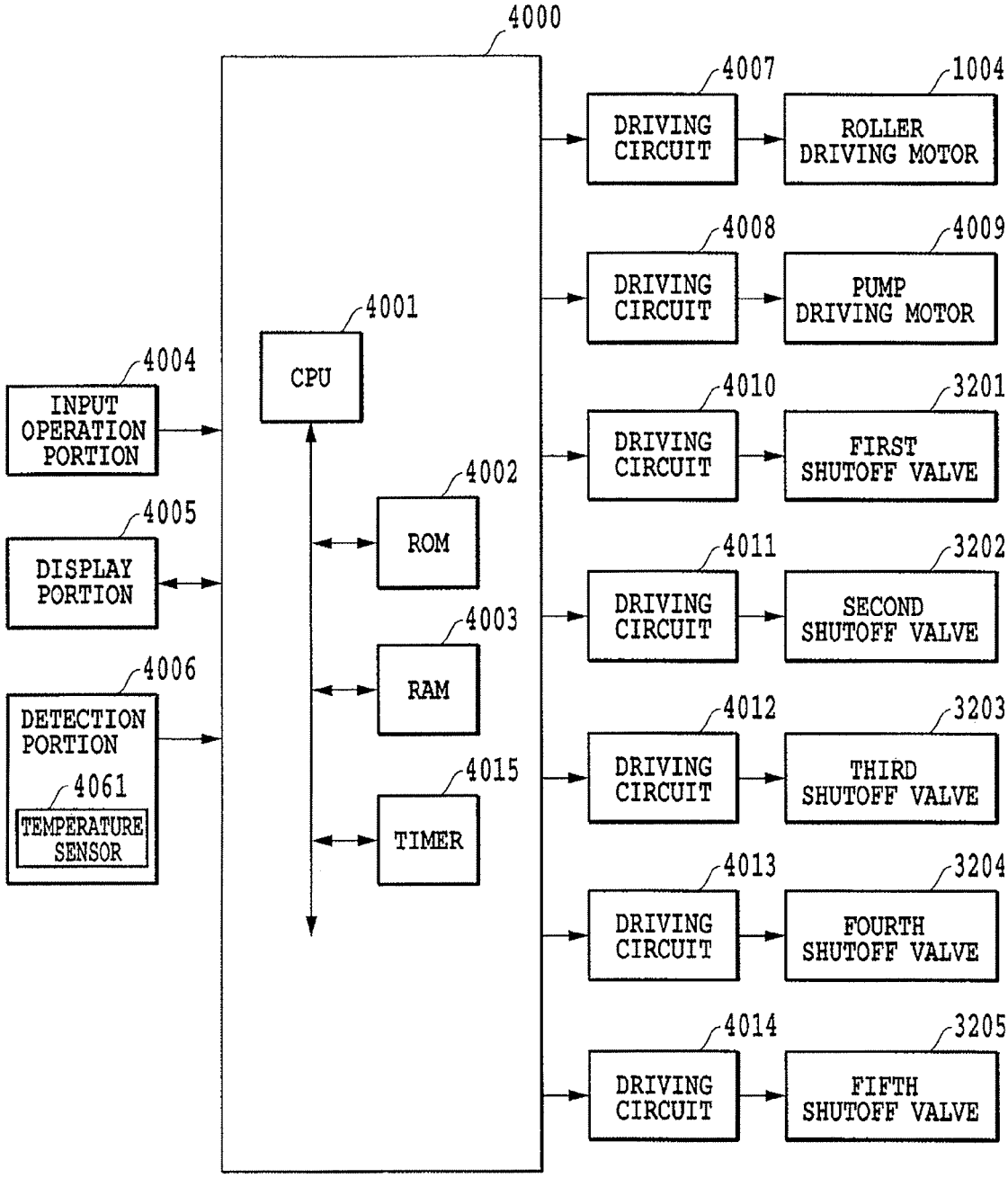
FIG. 12 is a block diagram showing an outline construction of a control system of a liquid applying apparatus according to an embodiment of the present invention.

FIG. 12 is a block diagram showing an outline construction of a control system in a liquid applying apparatus of this embodiment. In this figure, reference numeral 4000 denotes a control portion as a control means for controlling the entire liquid applying apparatus. The control portion 4000 has a CPU 4001 for executing processing operation such as various calculations, control and determination. Also, the control portion 4000 has a ROM 4002 for storing control programs, such as processing that will be described later in FIG. 13, executed by the CPU 4001 as well as a RAM 4003 for temporarily storing data which is under processing of the CPU 4001 and input data. Moreover, it has a timer for detecting use time or nonuse time of the apparatus that is referred to at the control of the flow velocity of the applying liquid as will be described later.

Moreover, to this control portion 4000 are connected an input operation portion 4004 including a keyboard for inputting a predetermined command or data or various switches and a display portion 4005 for making various displays including input/setting state of the liquid applying apparatus. It is also provided with a detection portion 4006 including a sensor for detecting a position of the applying medium and an operation state of each part. This detection portion has a temperature sensor 4061 for detecting an environment temperature to be referred to at the control of the flow velocity of the applying liquid, which will be described later. The roller driving motor 1004, the pump driving motor 4009, and the first to fifth shut-off valves are connected through driving circuits 4007, 4008 and 4010 to 4014, respectively.

(Liquid Applying Operation Sequence)

The processing of the liquid applying executed by the above construction of the applying apparatus will be described below. This processing includes control of a circulation speed according to an embodiment of the present invention. That is, it includes controlling the speed of a flow (circulation flow) generated in the liquid holding member 2001 due to circulation caused by supply of the applying liquid to the liquid holding member 2001 and recovery of the applying liquid therefrom.

Figure 13:
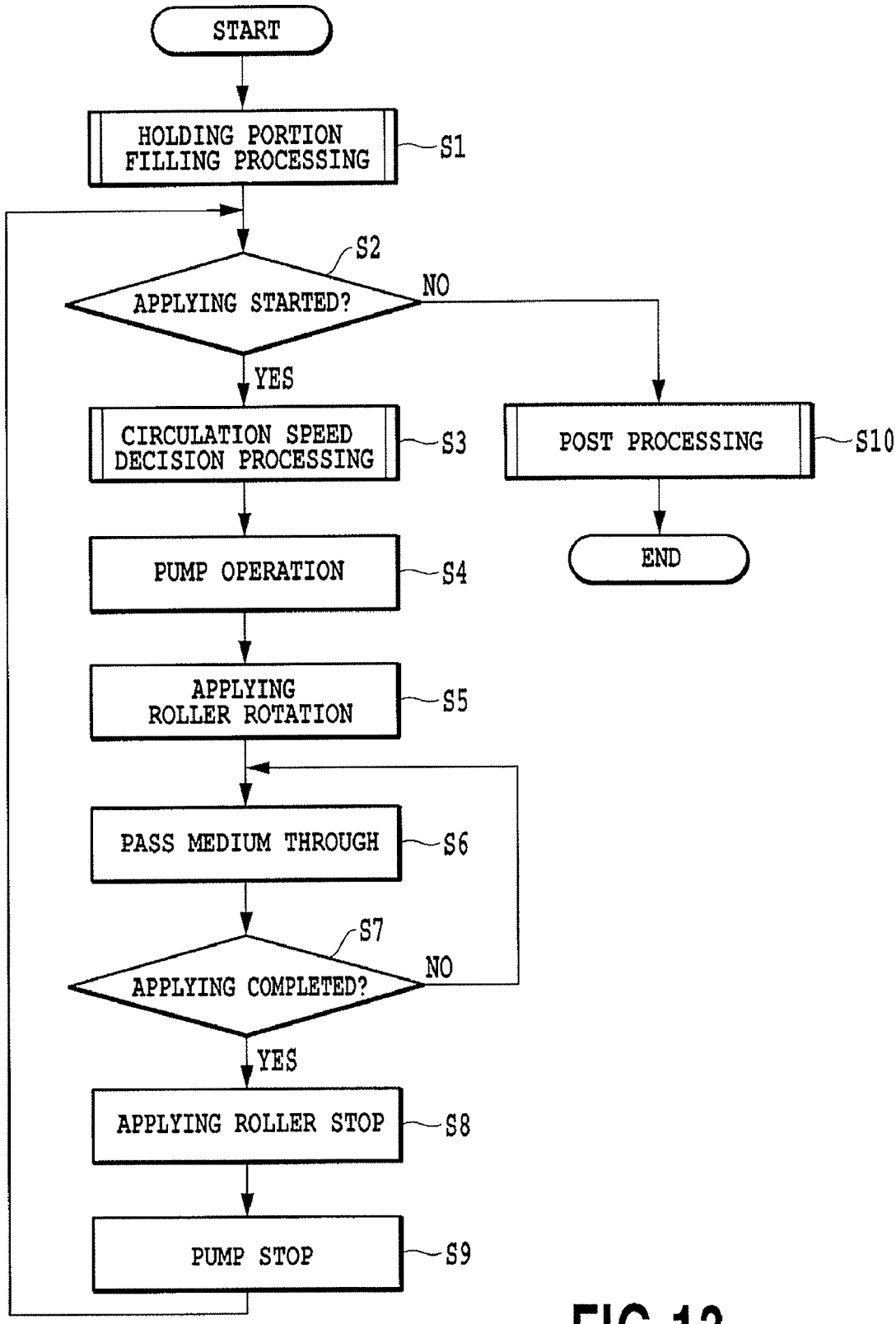
FIG. 13 is a flowchart showing a sequence of a liquid applying operation according to an embodiment of the present invention.

FIG. 13 is a flowchart showing a processing procedure of liquid applying in the liquid applying apparatus according to an embodiment of the present invention. Each process of the liquid applying will be described referring to this flowchart.

When the liquid applying apparatus is powered on, the control portion 4000 executes the following applying operation sequence according to the flowchart shown in FIG. 13.

The combinations of opening/closing of the respective shut-off valves shown in FIG. 11 are made to four combinations: "standing", "replenishing", "circulation" and "recovery." Moreover the control portion 4000 selects a combination suited to the state of the apparatus and sends a control signal to the respective shut-off valves to operate according to the selected combination.

TABLE 1

| | First shut-off valve | Second shut-off valve | Third shut-off valve | Fourth shut-off valve | Fifth shut-off valve |
|---|---|---|---|---|---|
| Standing | Open | Close | Close | Close | Close |
| Replenishing | Close | Close | Close | Open | Open |
| Circulation | Close | Open | Open | Close | Close |
| Recovery | Open | Close | Open | Close | Close |

Here, the "standing" shows a state of the respective shut-off valves while the apparatus is not in operation after the applying liquid has been recovered from the liquid holding space S. The "replenishing" shows a state of the respective shut-off valves where the applying liquid is being supplied from the replaceable tank to the buffer tank. The "circulation" shows a state of the respective shut-off valves where the applying liquid is circulated in the buffer tank, the first flow path, liquid holding space S and second flow path. The "recovery" shows a state of the respective shut-off valves where the applying liquid is recovered from the liquid holding space S to the buffer tank.

Filling Process

In FIG. 13, at Step S1, the filling process of the applying liquid to the liquid holding space S is executed. In this filling process, the respective shut-off valves are set to the opening/closing combination of "circulation" and the pump 3007 is driven for a certain period of time. This opening/closing combination allows the buffer tank 3002 to communicate with the liquid holding space S through the first and second flow paths. By this, if the applying liquid has not been filled in the liquid holding space S and the first and second flow paths, inside air is fed to the buffer tank 3002 by the pump and discharged to the atmospheric air through the atmospheric air communication port 3004, as well as the applying liquid is filled into the respective portions. On the other hand, if the respective portions have been already filled with the applying liquid, the applying liquid in the respective portions flows and is supplied with the appropriate concentration and viscosity. By this initial operation, the applying liquid is supplied to the applying roller 1001, enabling the applying medium to be applied.

Replenishing Process

At Step S1, if it is determined by a sensor or the like as the liquid-level control means for detecting the liquid level in the liquid holding space that the filling of the applying liquid in the buffer tank 3002 is insufficient, the respective shut-off valves are set to the "replenishing" opening/closing combination. At the same time, the pump 3007 is driven for a certain period of time. This opening/closing combination allows the buffer tank 3002 to communicate with the replaceable tank 3001 through the third and fourth flow paths. By this, the applying liquid is filled into the buffer tank 3002.

Circulation Speed Decision Process

Next, when an applying start command is inputted (Step S2), a circulation speed decision processing (Step S3) is carried out before the pump 3007 is driven again. In this embodiment, pressure in the liquid holding space is controlled by controlling the speed of the circulation flow generated in the liquid holding space defined by the liquid holding member 2001 and the applying roller 1001 according to the decided circulation speed. It results in changing the flow (movement) of the applying liquid at the portion where the contact member 2009 of the liquid holding member 2001 is in contact with the applying roller 1001 (portion N shown in FIG. 9), to control the amount of applying liquid which adheres to the applying roller 1001 and going out of the contact portion N. By this, the amount of the applying liquid transferred (applied) onto the applying medium P is controlled.

Figure 14:
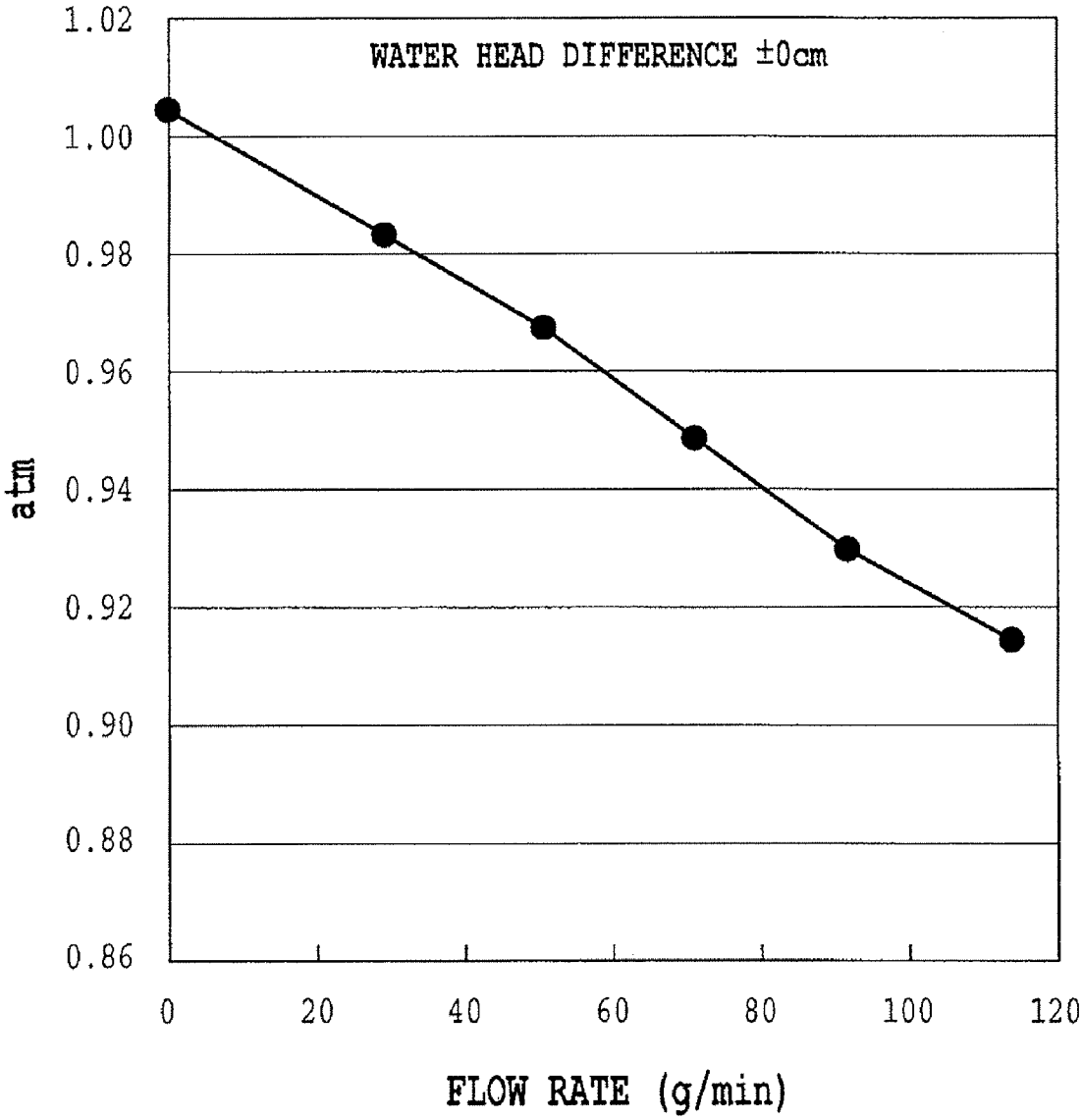
FIG. 14 is a graph showing a pressure in a liquid holding space in the above liquid applying apparatus, corresponding to a flow rate of a circulation flow.

FIG. 14 is a diagram showing a pressure in the liquid holding space according to the flow rate of the circulation flow. Here, since the cross-sectional area of the flow in the liquid holding space is constant, the above flow rate corresponds to the flow velocity. FIG. 14 shows an average pressure in the flow direction in the liquid holding space when the water head difference between the buffer tank 3002 and the liquid holding member 2001 in the flow path shown in FIG. 11 is 0 cm. The pressure is also distributed according to the flow velocity distribution in the flow direction of the liquid holding space but it shows a pressure tendency shown in FIG. 14 at any location.

Figure 15:
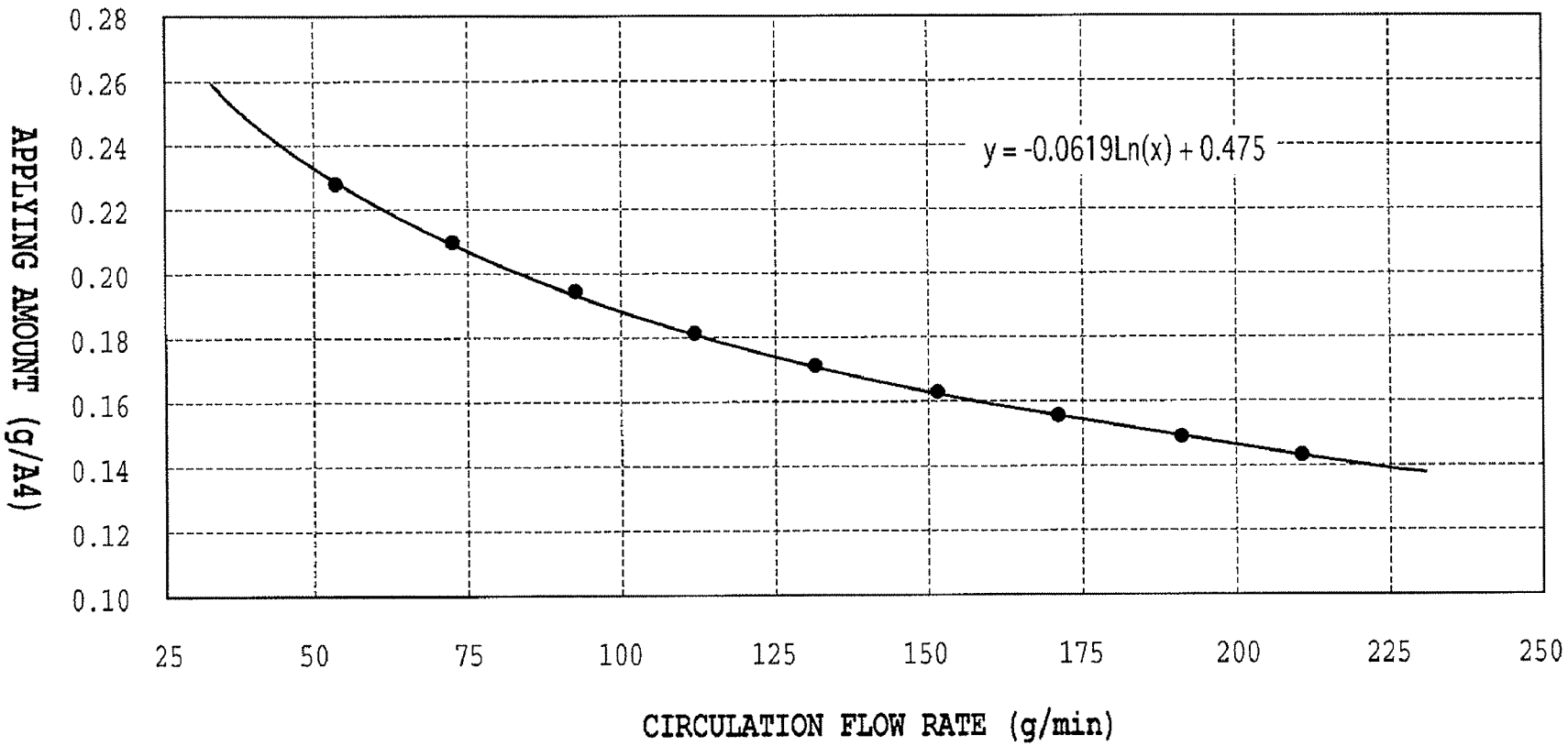
FIG. 15 is a graph showing a relation between the applying amount and the flow rate of the above circulation flow.

As is obvious from FIG. 14, the faster the flow velocity is, the lower the pressure in the liquid holding space becomes, that is, the larger the negative pressure in the liquid holding space becomes. Then, the lower the pressure in the liquid holding space is, the smaller the applying amount becomes. That is, the larger the negative pressure in the liquid holding space is, the smaller the amount of the applying liquid going out of the liquid holding space becomes. FIG. 15 is a graph showing a relation between the flow rate (thus, the flow velocity) of the circulation flow and the applying amount. As is obvious from this figure, the faster the flow velocity is, the smaller the applying amount becomes.

When the pressure in the liquid holding space is lowered, the contact pressure of the contact member 2009 against the applying roller 1001 is increased. As a result, the contact area of the contact portion N between the contact member 2009 and the applying roller 1001 is increased. Also, the state of meniscus of the applying liquid formed in a gap at the contact portion N is also changed. By changing the state of the contact portion N in this way, the amount of the applying liquid that can go out through the gap of the contact portion N from the liquid holding member 2001 can be changed. There can be other factors deciding the amount adhering to the applying roller and transported, but in any case, in this embodiment, when the pressure in the liquid applying member or the flow velocity of the circulation flow are used as parameters, the relation as shown in FIG. 15 is obtained between this parameter and the applying amount. Then the applying amount is controlled based on that.

It should be noted that the contact portion N is formed of the contact member and the applying roller along the longitudinal direction of the liquid holding member 2001, and as mentioned above, the pressure in the liquid holding space is distributed along the longitudinal direction. Thus, the amount of the applying liquid going out of the contact portion N might be different along the longitudinal direction of the liquid holding member. However, the difference in the amount is not so large that it can be recognized as uneven applying when applying the medium. In other words, there is a possibility that the uneven applying might occur in a construction, such as an elongated liquid holding member, where an extreme negative gradient pressure is formed. However, such a construction with an extreme negative pressure might cause another problem such as insufficient motor torque due to sticking of the liquid holding member. In addition, since there is a risk that the contact portion N causes leakage and air enters, such a construction is not practical.

In the circulation speed decision processing of this embodiment, the circulation speed that can correspond to the applying amount as mentioned above is decided according to the environment temperature, the type of paper to be used as the applying medium and the applying mode relating to the rotating speed of the applying roller. By this, even if the environment temperature, paper type or the rotating speed of the applying roller varies, the applying amount can be controlled to be constant.

Figure 16:
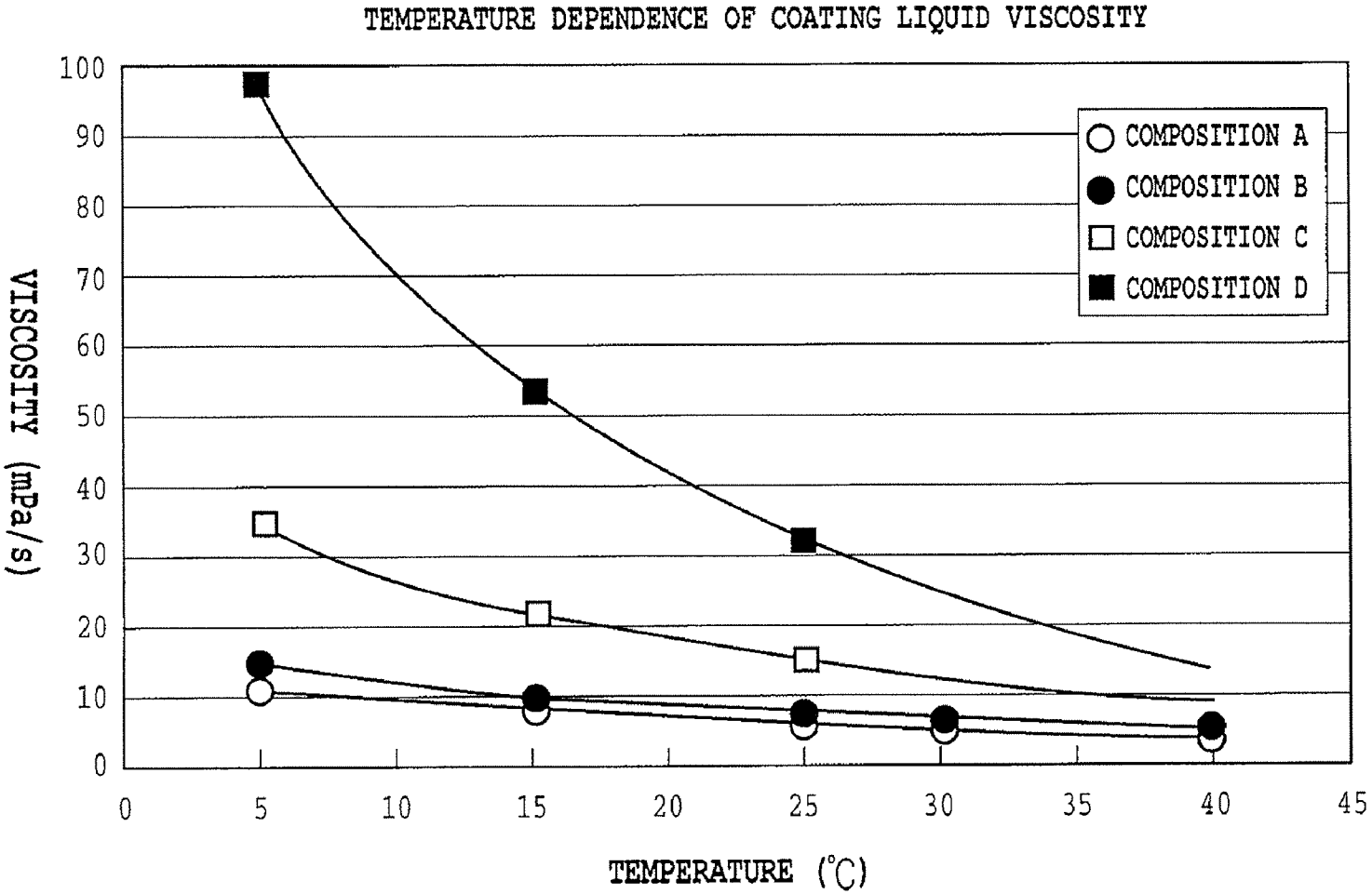
FIG. 16 is a graph for explaining temperature dependence of viscosity of an applying liquid.
Figure 17:
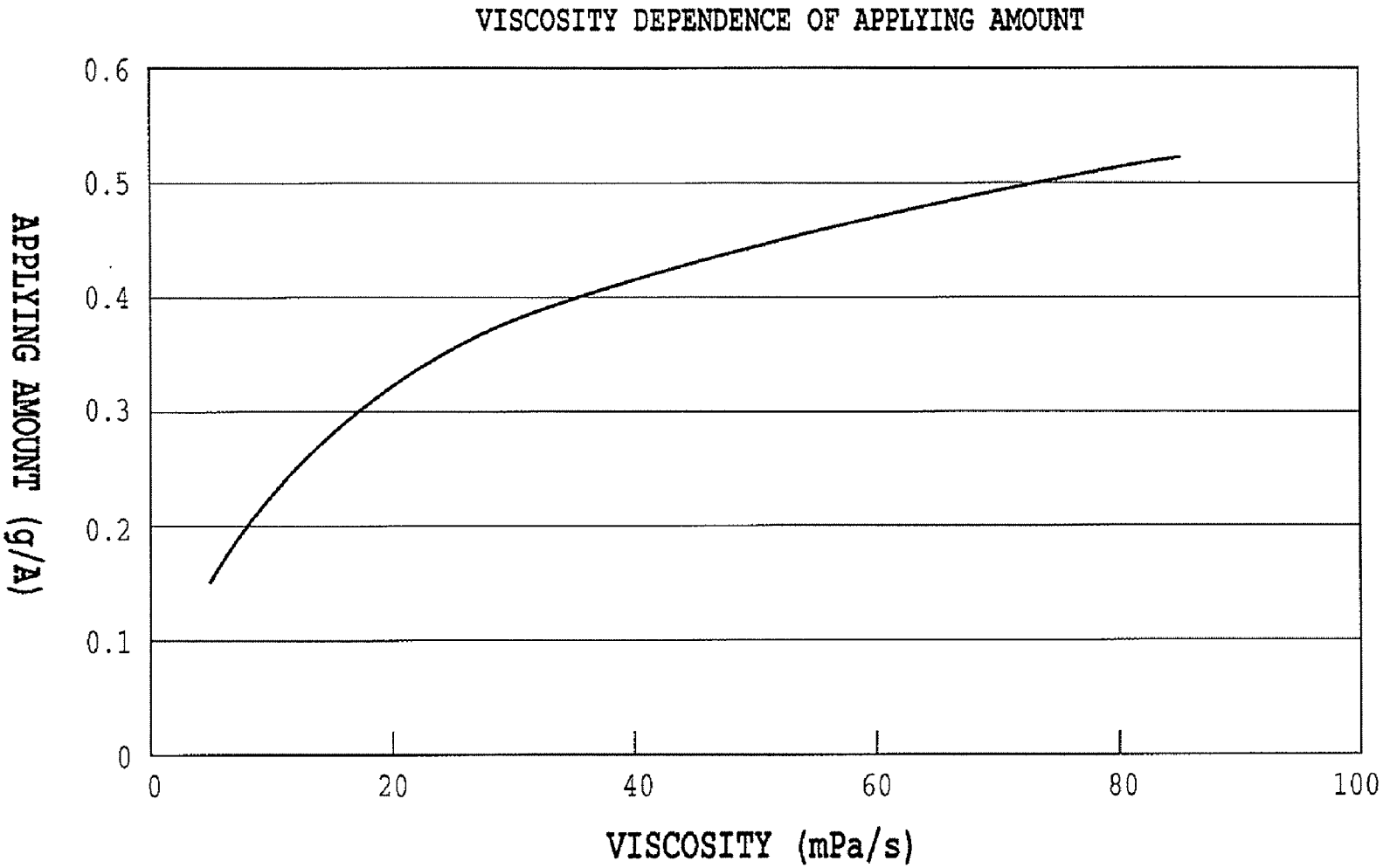
FIG. 17 is a graph for explaining viscosity dependence of an applying amount.

FIG. 16 is a graph explaining the temperature dependence of the viscosity of the applying liquid. As is obvious from the figure, the higher the temperature rises, the lower the viscosity becomes in any of the applying liquid with compositions A, B, C and D. FIG. 17 is a graph explaining the viscosity dependence of the applying amount. As is shown in this figure, the higher the viscosity is, the more the applying amount becomes. When the characteristics shown in FIGS. 16 and 17 are put together, the higher the temperature is, the smaller the applying amount becomes. As a result, in the applying amount control of this embodiment, when the temperature is higher, the applying amount of the liquid is increased by lowering the circulation speed, so that the constant applying amount is maintained irrespective of the temperature change.

The amount transferred (applied) onto the applying medium is changed according to the irregularity of the surface of the applying medium such as paper. Generally, the rougher the surface is with the larger irregularity, the smaller the amount to be applied becomes. In this embodiment, such control is carried out that, by lowering the circulation speed so as to increase the applying amount for the applying medium with the rougher surface so that the applying amount is maintained constant irrespective of the type of the applying medium to be used.

Figure 18:
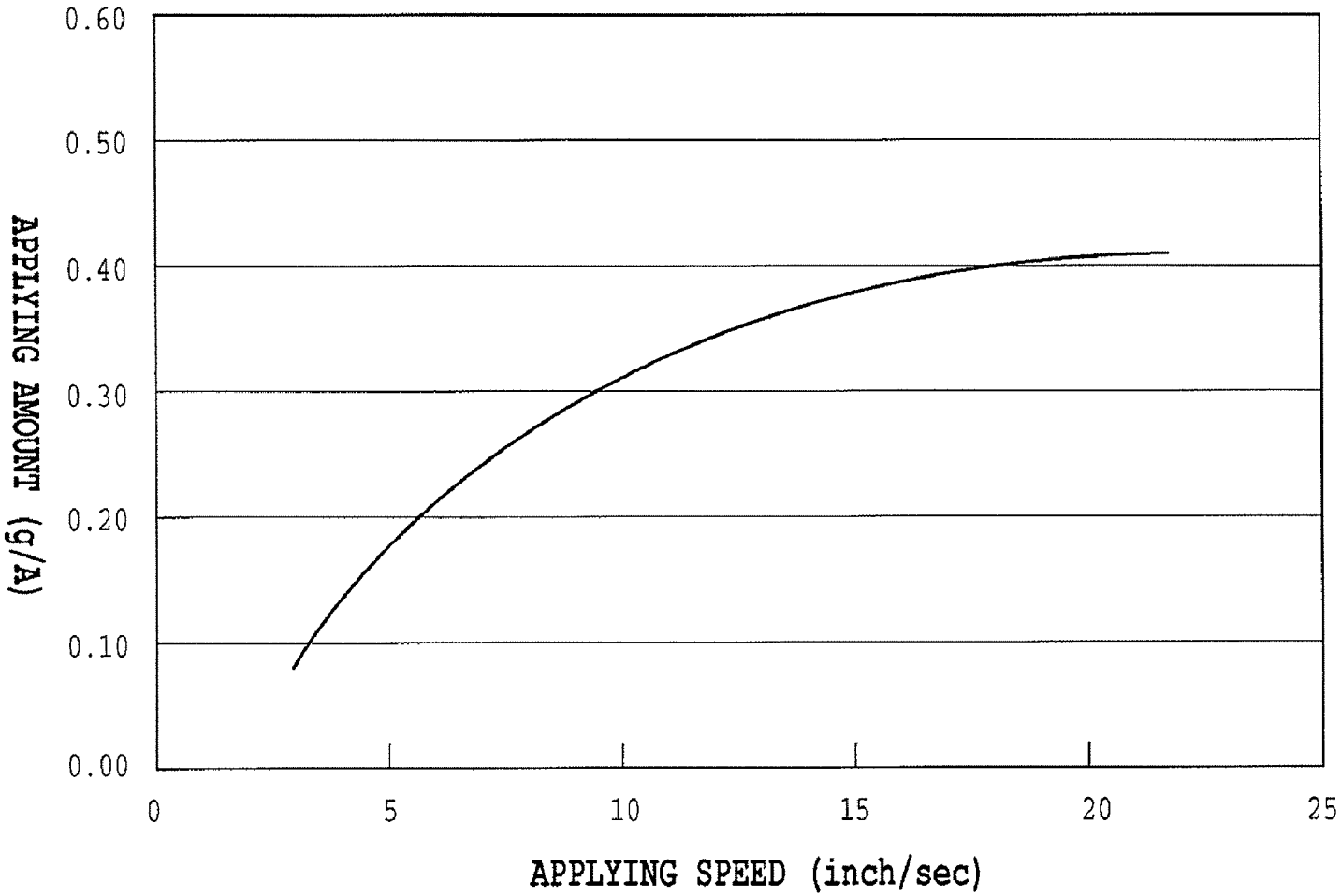
FIG. 18 is a graph for explaining a relation between an applying speed and an applying amount.

Moreover, the applying amount is changed according to the applying speed of the applying member such as the applying roller to the applying medium. FIG. 18 is a graph showing a relation between the applying speed and the applying amount. As is shown in this figure, the faster the applying speed (rotating speed of the applying roller in this embodiment) is, the larger the applying amount becomes. Therefore, in the applying amount control of this embodiment, in the mode where the rotating speed of the applying roller is faster, the applying amount of the liquid is decreased by increasing the circulation speed so that constant applying amount is maintained irrespective of the applying mode. If the rotation speed of the applying roller is changed, it is necessary to change the rotation speeds of the counter roller 1002, the discharge roller 1007 and the like in accordance with the change of the rotation speeds of the counter roller 1002. It is needless to say that changing the rotating speed of the applying roller cases the conveying speed of the applying medium to be changed.

FIG. 19 is a table used for circulation speed decision processing of this embodiment. In this figure, with regard to the "temperature" indicating the value of the environment temperature, if it is higher than a predetermined threshold temperature, it is "High", while if it is not higher than the predetermined threshold temperature, it is "Low". As for the "paper type" indicating the type of the applying medium, if the irregularity on the surface of the paper is rougher than a predetermined roughness, it is "Rough", while if it is not rougher than the predetermined roughness, it is "Smooth". Moreover, as for the "grade" corresponding to the applying speed, a mode where a rotating speed of the applying roller 1001 is slower than a predetermined rotating speed is "High", while the mode where the speed is not slower than the predetermined rotating speed is "Low". The mode with the slower rotating speed has the slower applying speed. In this case, applying with a higher noise grade with lower noise can be carried out.

In the table shown in FIG. 19, a "pump speed", which is a driving speed of the pump, is decided based on the values of the above parameters: "temperature", "paper type" and "grade". The pump speed gets faster sequentially in order from A, B, C . . . G, H. If the temperature is "High" and the grade is "High", for example, the pump speed is made faster when the paper type is "Smooth" than the case where it is "Rough" (A<B). Also, if the temperature is "Low" and the grade is "High", the pump speed is made faster than the above case, and the pump speed is also faster when the paper type is "Smooth" than the case where it is "Rough" (A<B<. . . <E<F). In this way, any of the pump speeds A to H is decided according to the "temperature", "paper type" and "grade".

With the decided pump speed, the pump is driven in the next applying process. In this embodiment, a driving voltage for achieving the decided pump speed is applied to the pump to be driven. As a result, the applying amount is maintained constant by controlling the speed of the circulation flow in the liquid holding member 2001.

In this embodiment, the "temperature", which is the environment temperature of the liquid applying apparatus, is detected by the temperature sensor 4061 shown in FIG. 12. And, the "paper type", which is the type of the applying medium, can be detected by input set by a user through the input operation portion 4004. It is needless to say that this paper type can be also detected with a well-known detection mechanism using an optical sensor. Moreover, the "grade" can be determined according to the liquid applying mode set by a user through the input operation portion 4004.

It is needless to say that the parameters deciding the pump speed are not limited to the "temperature" and the like in the above example. For example, a standing time of an apparatus, which affects the viscosity of the applying liquid, can be used as a parameter. The longer the standing time becomes, the more evaporation is generated. It increases the viscosity of the applying liquid. If the standing time is used as a parameter, an elapsed time from the end of circulation of the applying liquid to the start of the next circulation may be measured with the timer 4015 shown in FIG. 12, for example and the pump speed may be controlled according to the time. Thus, any factor affecting the viscosity of the applying liquid can be used as a parameter in deciding the pump speed.

The applying amount might be changed according to the duration of use of the applying liquid or the applying roller. For example, when the applying liquid or the applying roller is deteriorated due to its use, the applying amount might be changed. Therefore, their durations of use can be used as parameters in deciding the pump speed.

Moreover, in the above embodiment, it was described that the applying amount depends on the surface state of the applying medium. The applying amount might be different depending on the thickness of the applying medium. Therefore, this thickness can be used as a parameter in deciding the pump speed. Also, the mode according to the rotating speed of the applying roller described in the above embodiment relates to the applying grade, but the mode is not limited to that. For example, if there is a mode such as a silent mode in which the applying roller rotates at a relatively low speed, the driving speed of the pump can be decided according to the rotating speed.

In addition, the control of the circulation speed described in the above-mentioned embodiment is to control the circulation speed in the liquid holding space when applying is being conducted to the applying medium while the applying medium is held between the applying roller and the counter roller. For example, if the pump is driven before the applying medium is fed to between the applying roller and the counter roller or if the pump is driven while the applying is not being conducted on the medium during post processing or the like, the circulation speed is not controlled but the pump is driven at a constant speed.

Applying Process

Referring to FIG. 13, again, when the above-mentioned circulation speed decision processing (Step S3) is completed, the pump driving starts at the decided pump speed (Step S4) and the applying roller 1001 starts to rotate clockwise as shown by an arrow in FIG. 2 (Step S5). By this rotation of the applying roller 1001, the applying liquid L filled in the liquid holding space S passes through the contact portion N of the applying roller 1001 and the lower edge portion 2011 of the contact member 2009 against the pressing force of the contact member 2009 of the liquid holding member 2001 against the applying roller 1001. And the applying liquid adheres to the outer circumference of the applying roller 1001 in a layered state. The applying liquid L adhering to the applying roller 1001 is fed to the contact portion of the applying roller 1001 and the counter roller 1002.

Figure 9:
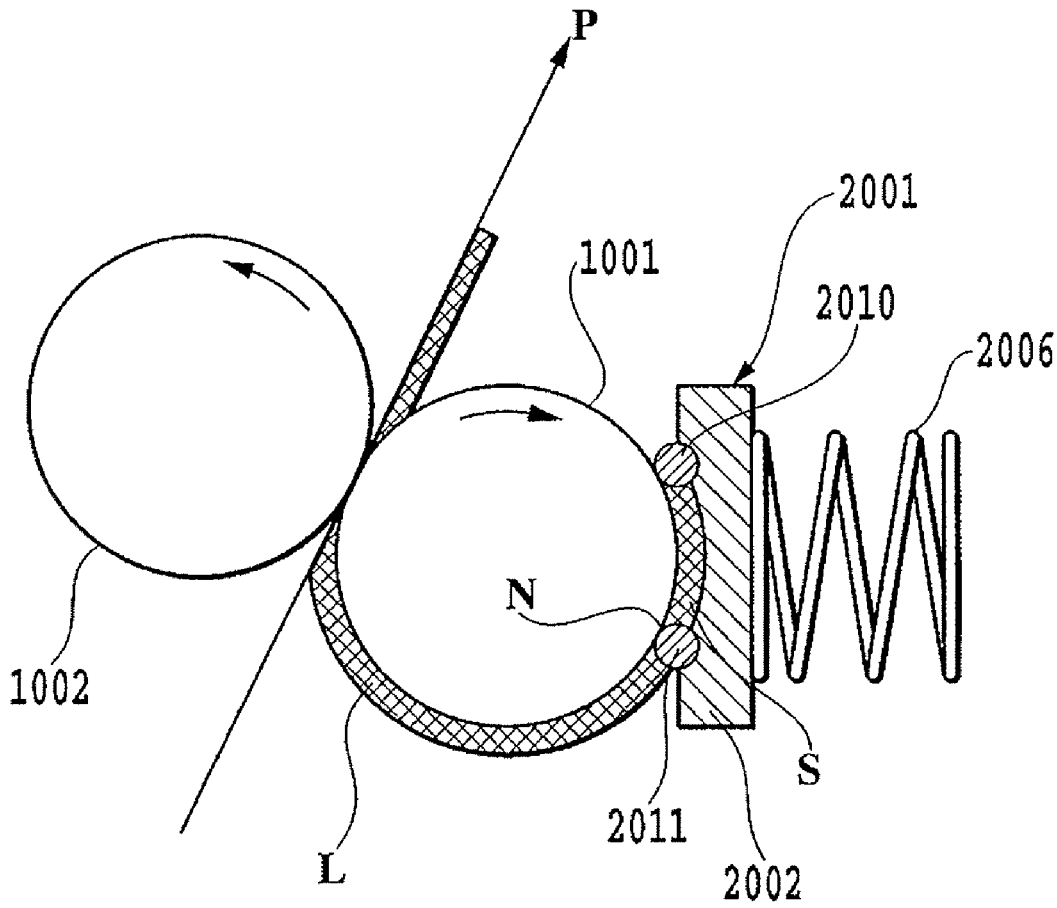
FIG. 9 is a longitudinal sectional view showing a state where an applying liquid is filled in a liquid holding space defined by the liquid holding member and the applying roller and the liquid is applied to an applying medium by rotation of the applying roller.

Then, the applying medium is conveyed to a portion between the applying roller 1001 and the counter roller 1002 by an applying medium supply mechanism 1006. With this, the applying medium is inserted between these rollers and conveyed to a paper discharge portion with rotation of the applying roller 1001 and the counter roller 1002 (Step S6). During this conveyance, the applying liquid adhered to the outer circumferential surface of the applying roller 1001 is transferred to the applying medium P from the applying roller 1001 as shown in FIG. 9. The amount to be transferred is controlled to be constant by the above-mentioned control of the circulation speed.

It is needless to say that the means for supplying the applying medium to the portion between the applying roller 1001 and the counter roller 1002 is not limited to the above supply mechanism. For example, manual insertion using a predetermined guide member as a supplementary means may be used in combination with the above mechanism, manual insertion is used alone or any other mechanism may be used.

In FIG. 9, a portion expressed with crossing lines indicates the applying liquid L. Here, the thickness of the applying liquid layer on the applying roller 1001 and on the applying medium P is expressed in an exaggerated manner than an actual thickness for clear representation of the state of the applying liquid L at applying.

As mentioned above, the applied portion of the applying medium P is conveyed in the arrow direction by a conveying force of the applying roller 1001. With this, an unapplied portion of the applying medium P is conveyed to the contact portion of the applying medium P and the applying roller 1001, and the applying liquid is applied over the entire applying medium by carrying out this operation continuously or intermittently.

FIG. 9 shows an ideal applying state where all the applying liquid L which has passed through between the contact member 2009 and the applying roller 1001 and adhered to the roller is transferred to the applying medium P. However, in actuality, not all of the applying liquid L adhering to the applying roller 1001 is transferred to the applying medium P. That is, when the applying medium P to be conveyed is separated from the applying roller 1001, the applying liquid L might adhere to the applying roller 1001 and remain on it. The applying liquid that remains on this applying roller 1001 passes between the applying roller 1001 and the upper edge portion 2010 of the contact member 2009 against the pressing force of the contact member 2009 of the liquid holding member 2001 against the applying roller 1001 and returns into the liquid holding space S. And it is mixed with the applying liquid filled in the space S.

In this embodiment, the circulation speed is controlled, considering the return amount of the applying liquid so that the amount finally to be transferred to the applying medium is maintained constant.

Figure 10:
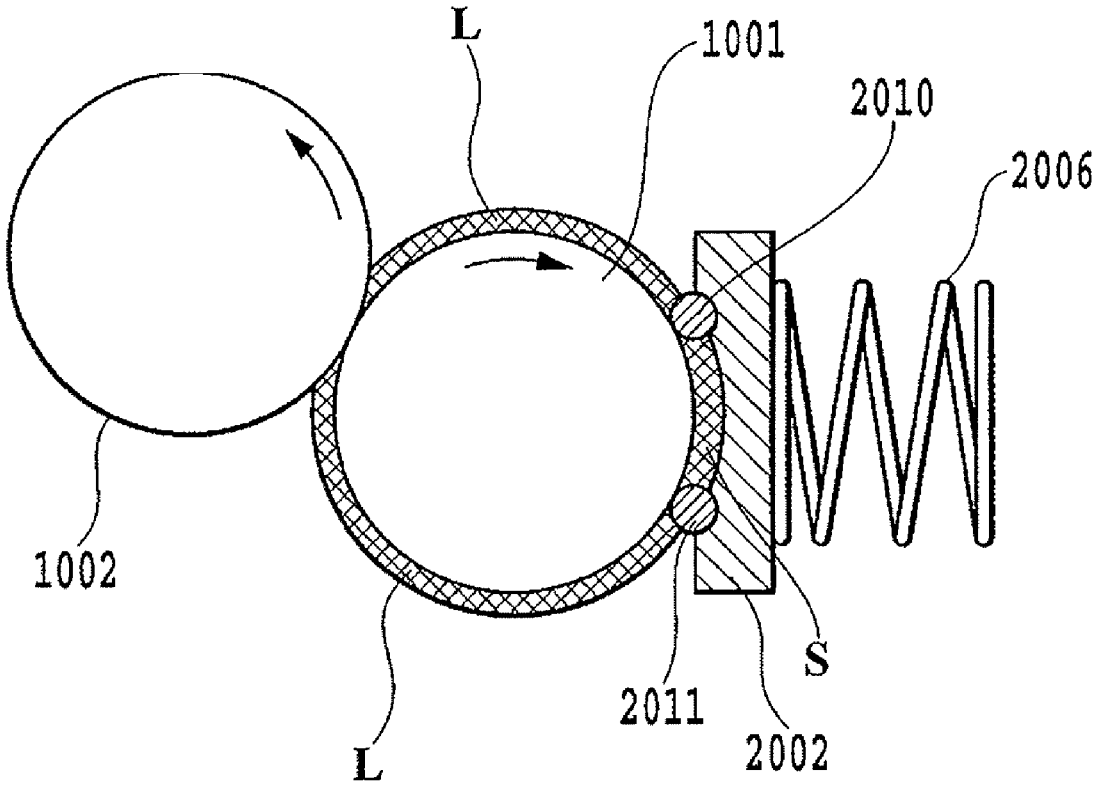
FIG. 10 is a longitudinal sectional view showing a state where an applying liquid is filled in a liquid holding space defined by a liquid holding member and an applying roller and the applying roller is rotated while an applying medium does not exist in an embodiment of the present invention.

Moreover, this returning operation of the applying liquid is also carried out even if the applying roller 1001 rotates while the applying medium does not exist as shown in FIG. 10. That is, by rotating the applying roller 1001, the applying liquid adhering to the outer circumference of the applying roller 1001 passes through the portion (nip portion) of the applying roller and the counter roller 1002. After passing through it, the applying liquid is divided into the applying roller 1001 side and the counter roller 1002 side, and the applying liquid remains on the applying roller 1001. And the applying liquid L adhering to the applying roller 1001 passes through between the upper edge portion 2010 of the contact member 2009 and the applying roller 1001 and enters into the liquid holding space S, where it is mixed with the applying liquid filled therein.

End Process

When the applying operation to the applying medium has been executed as mentioned above, determination is made if the applying process may be completed or not (Step S7). If the applying process is not to be completed, the process returns to step S6, where the applying operation is repeated till the applying process is completed for all the portions requiring applying of the applying medium. When the applying process is completed, the applying roller 1001 is stopped (Step S8), and moreover, driving of the pump 3007 is stopped (Step S9). After that, the process goes on to Step S2, and if the applying start command has been inputted, the operation in the above Steps S2 to S8 is repeated. If the applying start command has not been inputted, on the other hand, post processing, such as recovery operation to recover the applying liquid in the holding space S and the liquid flow paths, is carried out (Step 10), and the processing relating to the applying is completed.

For the above recovery operation, the opening/closing combination of the respective shut-off valves is set to "recovery" and the pump 3007 is driven for a certain period of time. This opening/closing combination allows the liquid applying space S to communicate with the buffer tank 3002 through the second flow path and with the communication port 3008 that is the atmospheric air communication port through the first flow path. By this, the atmospheric air is supplied to the tubes 3102, the liquid applying space S, the tubes 3103, 3104, the pump 3007 and the tube 3105, and the filled applying liquid is recovered to the buffer tank 3002. By performing this recovery operation, evaporation of the applying liquid from the liquid holding space S can be fully prevented or reduced.

Also, after the recovery operation, the respective shut-off valves are set to the opening/closing combination of "standing". With this opening/closing combination, the replaceable tank 3001, the buffer tank 3002 and the liquid applying space S are shut off from each other. As a result, movement between the tanks or outflow to the outside of the applying liquid can be prevented or reduced even if the attitude of the apparatus is tilted during movement, transportation and the like.

According to the above described embodiments, driving of flowing liquid means (pump) for causing a liquid in the liquid holding space to flow is controlled so that the applying amount of the liquid can be adjusted. More specifically, controlling of driving the pump causes the flow speed of the liquid in the liquid holding space to change so that the pressure in the liquid holding space varies. Thereby, the contact force of the liquid holding member against the applying roller varies, and with this variation the amount of applying liquid which goes out of the contact portion varies. In this way, applying amount of the applying liquid can be adjusted.

(Embodiment of the Ink-Jet Printing Apparatus)

Figure 20:
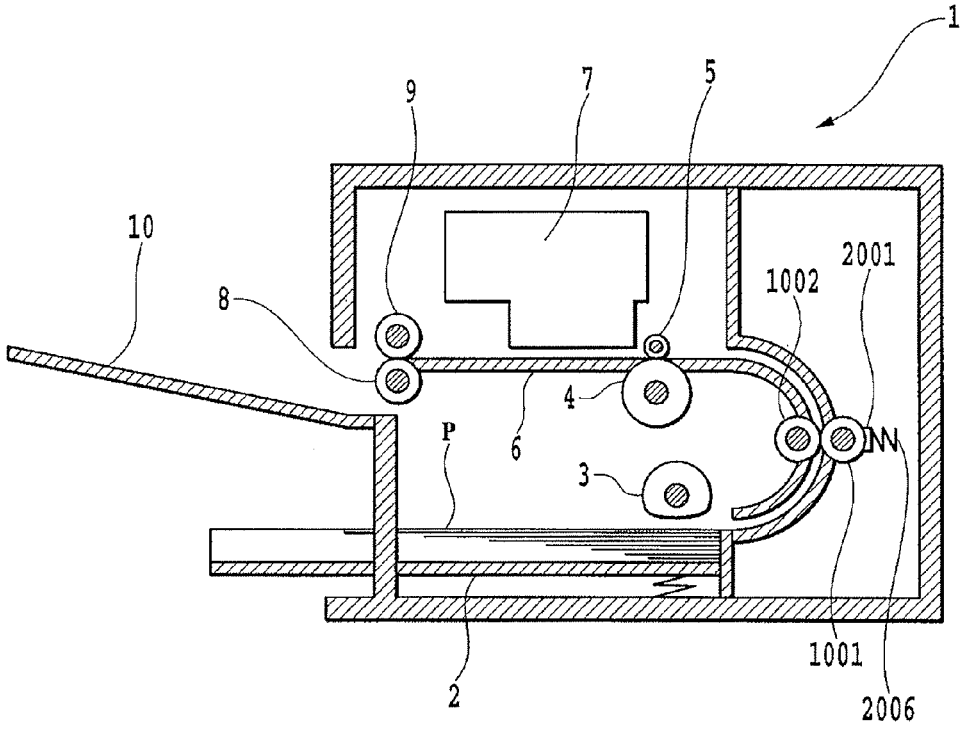
FIG. 20 is a longitudinal sectional side view showing an outline construction of an ink-jet printing apparatus according to another embodiment of the present invention.

FIG. 20 shows an outline construction of an ink-jet printing apparatus provided with the applying mechanism having approximately the same construction as the above-mentioned liquid applying apparatus. In this ink-jet printing apparatus 1, a feed tray on which a plurality of printing media P are loaded is provided, and a separation roller 3 of a semilunar shape separates the printing media P loaded on the feed tray one by one and feed it to a conveying path. In the conveying path, an applying roller 1001 and a counter roller 1002 that constitute the liquid applying means of the above liquid applying mechanism are arranged, and the printing medium P fed from the feed tray 2 is fed into between the both rollers 1001, 1002. The applying roller 1001 rotates in the clockwise direction in FIG. 20 by the rotation of the roller driving motor and applies the applying liquid on the printing surface of the printing medium P while conveying the printing medium P. The printing medium P applied with the applying liquid is fed into a portion between the conveying roller 4 and the pinch roller 5, and by the counterclockwise rotation of the conveying roller 4 in the figure, the printing medium P is conveyed onto the platen 6 and moved to a position opposite to the printing head 7 constituting the printing means. The printing head 7 is an ink-jet printing head on which the predetermined number of nozzles for ink ejection are disposed, and while the printing head 7 makes scanning in the direction perpendicular to the paper surface of the figure, ink drips are ejected from the nozzles to the printing medium P according to printing data to carry out printing. By alternately repeating this printing operation and a predetermined amount of conveying operation by the conveying roller 4, images are formed on the printing medium. With this image forming operation, the printing medium P is held between the paper discharge roller 8 and the paper discharge spur 9 provided on the down-stream side of the scanning area of the printing head in the conveying path of the printing medium and discharged onto the paper discharge tray 10 by rotation of the paper discharge roller 8.

As a ink-jet printing apparatus, a so-called full-line type ink-jet printing apparatus, which performs printing operation using a lengthy printing head provided with nozzles for ejecting ink over the maximum width of the printing medium, may be constituted.

The applying liquid used in this embodiment is a processing liquid accelerating an aggregation of a pigment when performing printing with an ink having the pigment as a color material. In this embodiment, by using the processing liquid as the applying liquid, aggregation of the pigment is accelerated by making this processing liquid react with the pigment that is a color material of the ink to be ejected onto the printing medium applied with this processing liquid. And this insolubilization can improve the printing density. Moreover, it can reduce or prevent bleeding. It is needless to say that the applying liquid used in the ink-jet printing apparatus is not limited to the above example.

Figure 21:
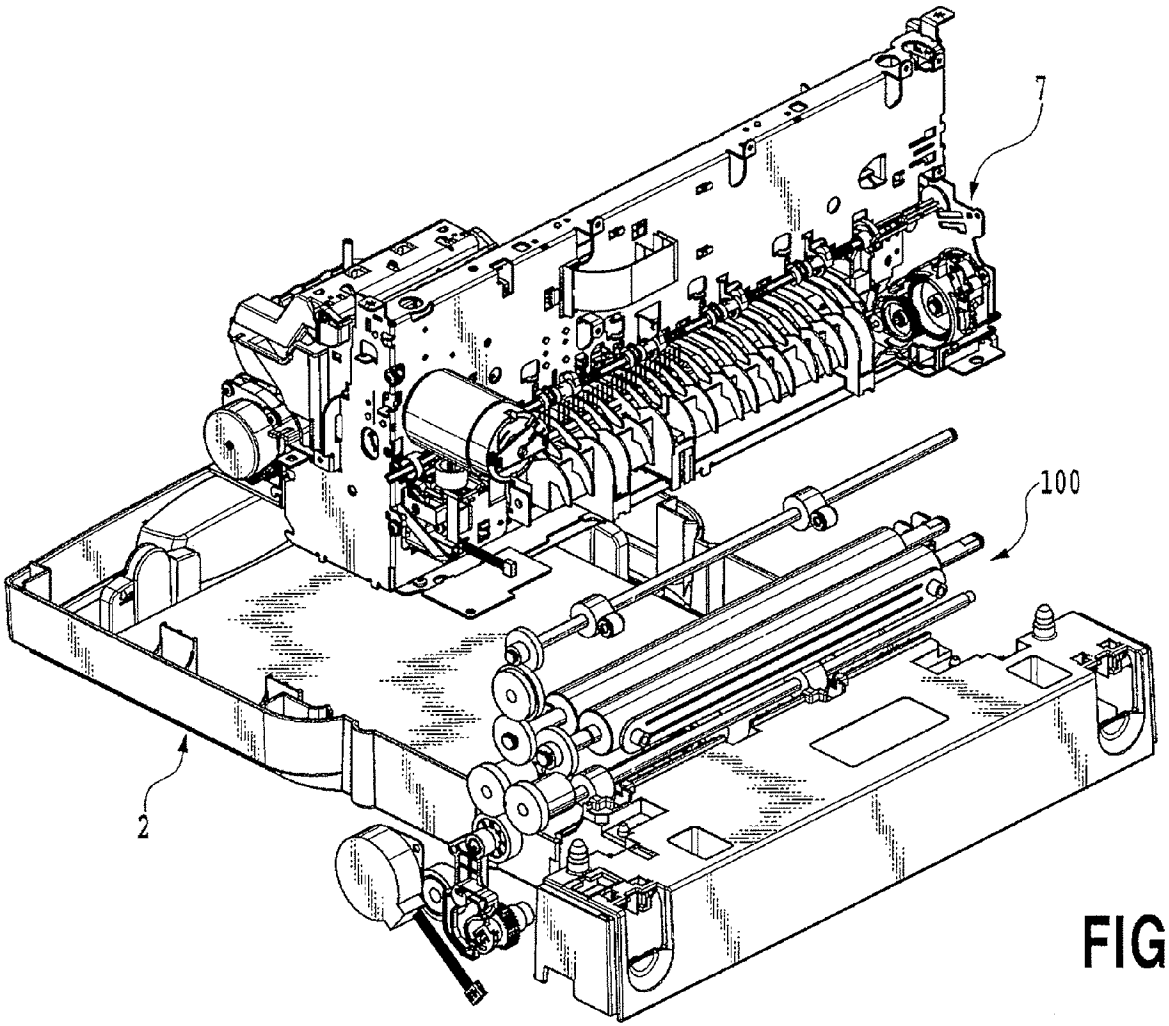
FIG. 21 is a perspective view showing an essential part of the ink-jet printing apparatus shown in FIG. 20.

FIG. 21 is a perspective view showing an essential part of the above-mentioned ink-jet printing apparatus. As shown in this figure, an applying mechanism 100 is provided above one end of the feed tray 2, and a printing mechanism with the printing head 7 is provided above the center of the feed tray 2 and the higher position than that of the applying mechanism.

Figure 22:
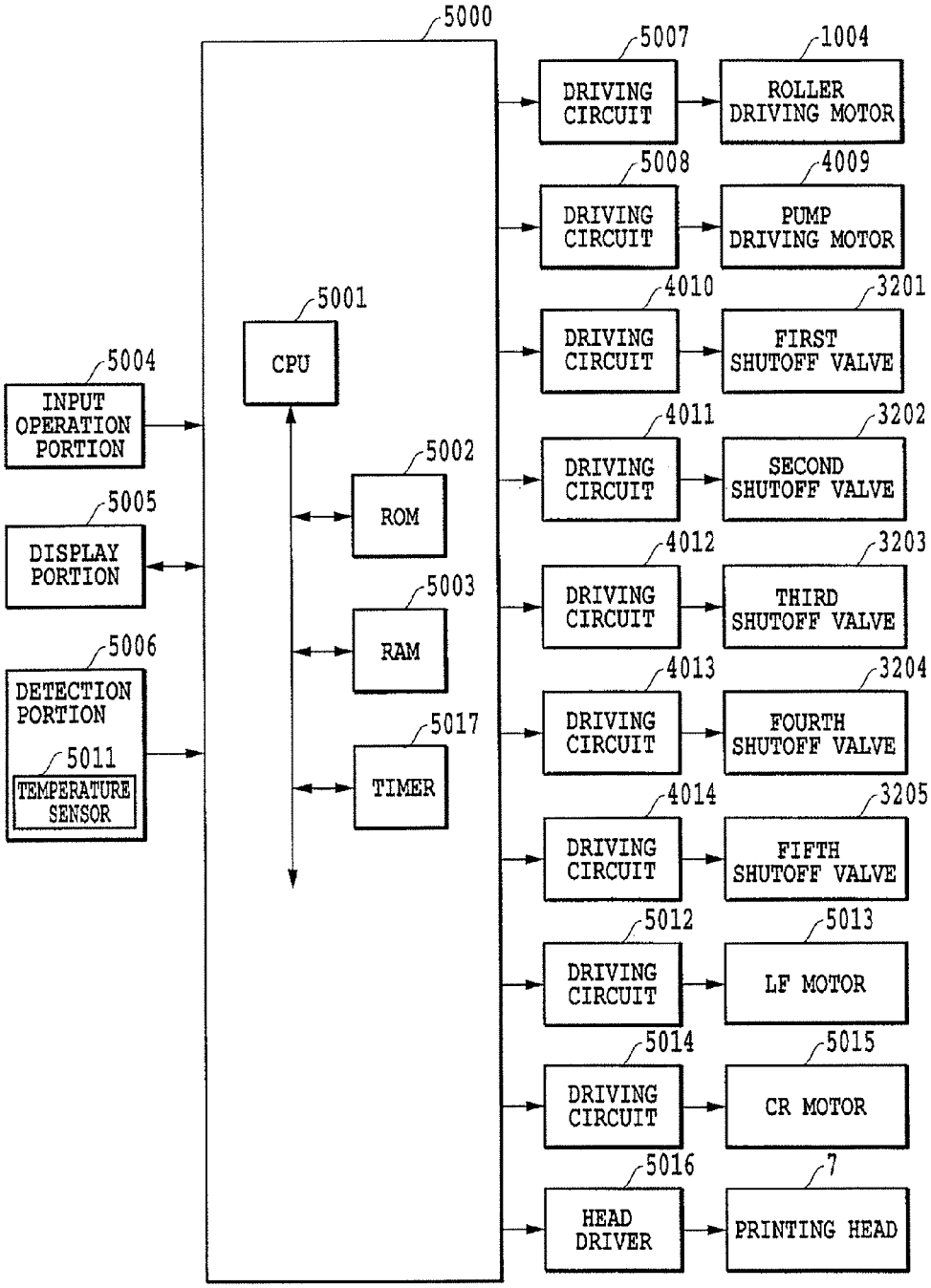
FIG. 22 is a block diagram showing an outline construction of a control system of the ink-jet printing apparatus shown in FIG. 20.

FIG. 22 is a block diagram showing an outline construction of a control system of the above-mentioned ink-jet printing apparatus. In this figure, the roller driving mechanism 1004, the pump driving motor 4009 and shut-off valves 3201-3205, which are elements of the liquid applying mechanism, are the same elements as those described in the above-mentioned liquid applying apparatus. Similarly to the embodiment of the above applying apparatus, a detection portion 5006 has a temperature sensor 5011, and a controller 5000 has a timer 5017.

A CPU 5001 controls driving of each element of the applying mechanism according to the program of a processing procedure, which will be described later in FIG. 23. It also controls driving of an LF motor 5013 a CR motor 5015 and the printing head 7 of the printing mechanism through driving circuits 5012, 5014 and 5016 respectively. That is, the driving of the LF motor 5013 rotates the conveying roller 4 and the like, and the driving of the CR motor moves a carriage on which the printing head 7 is mounted. Moreover, control to eject ink from the nozzles of the printing head is carried out.

Figure 23:
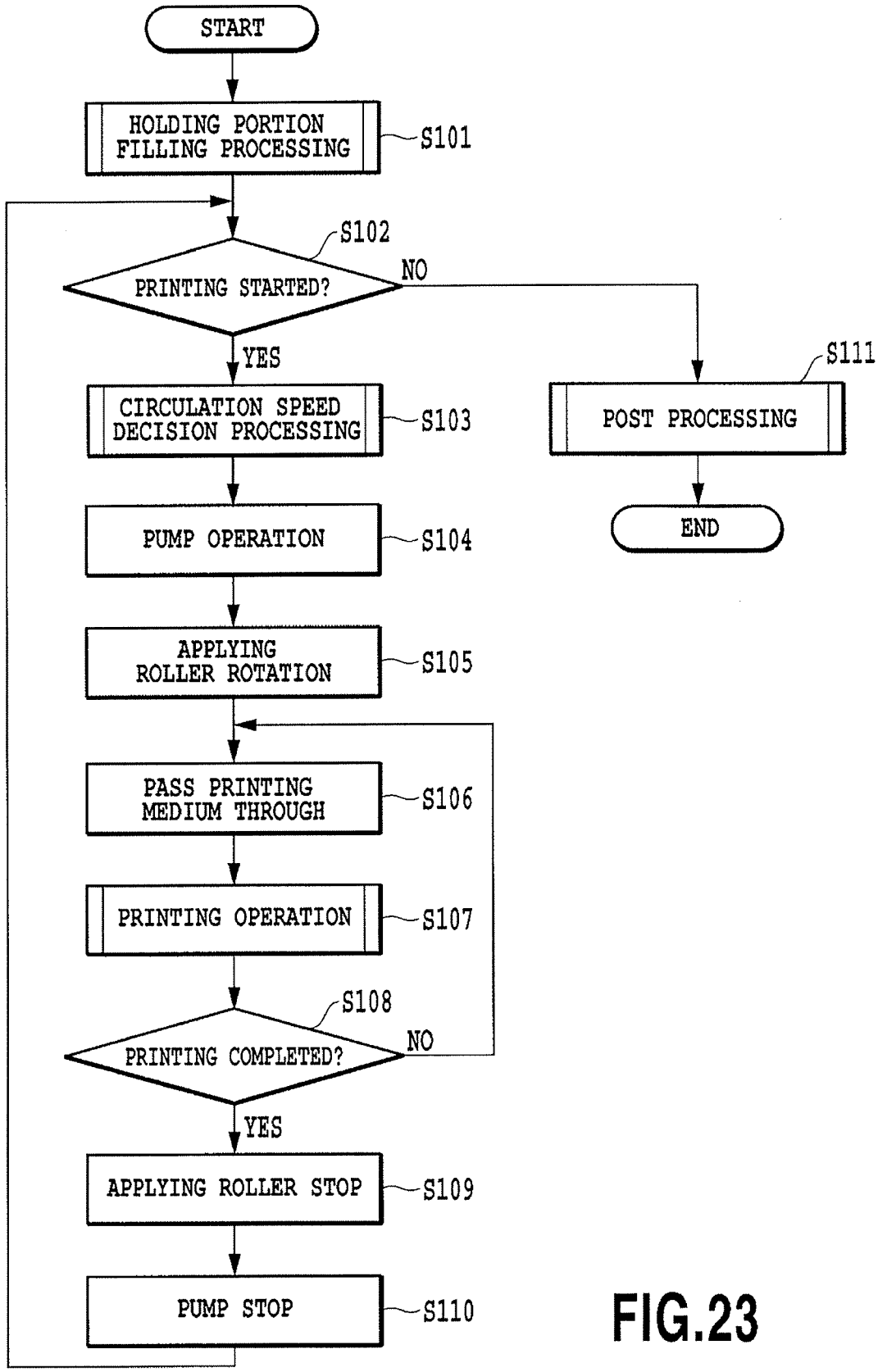
FIG. 23 is a flowchart showing a sequence of a liquid applying operation and a printing operation executed in the ink-jet printing apparatus shown in FIG. 20.

FIG. 23 is a flowchart showing a procedure of the liquid applying and printing operation involved in it in the ink-jet printing apparatus of this embodiment.

In this figure, the processing in Steps S101, S103 to S106 and Step S109 to S111 are the same as the processing in Steps S1, S3 to S6 and S8 to S10, respectively.

As shown in FIG. 23, when a command to start printing is given (Step S102), a series of liquid applying operations including circulation speed decision processing and a pump operation are carried out (Steps S103 to S106). Thereby the liquid is applied to portions of the printing medium that require liquid applying.

After this applying process, the printing operation is carried out for the printing medium on which the applying liquid has been applied to the portions as required (Step S107). That is, the printing head 7 is made to scan the printing medium P conveyed by the conveying roller 4 by a predetermined amount and ink is ejected from the nozzles according to the printing data during this scanning to apply the ink to the printing medium and form dots on it. Since the applied ink reacts with the applying liquid, printing density can be improved and bleeding can be prevented. By repeating the above conveying of the printing medium and scanning with the printing head, printing is made on the printing medium P and the printed printing medium is discharged onto the paper discharge tray 10. When it is determined that printing has been completed at Step S108, processing at Step S109 and after is carried out and this whole processing is finished.

In this embodiment, with liquid applying to the printing medium, printing is performed sequentially to the portion where the applying has been finished. More specifically, the embodiment is the case that when the length of the conveying path from the applying roller to the printing head is shorter than the length of the printing medium, and when the portion of the printing medium on which the liquid has been applied reaches the scanning area by the printing head, applying is performed by the applying mechanism to another portion on the printing medium. That is, liquid applying and printing are performed sequentially on different portions of the printing medium per predetermined amount of conveyance of the printing medium. However, in another application of the present invention, printing may be performed after applying on one printing medium is completed.

Also, in the printing apparatus of the present invention, by applying a liquid including a fluorescent whitening agent by the liquid applying mechanism, whiteness of the medium can be improved. In this case, the printing means after the liquid applying is not limited to the ink-jet printing method but a printing method such as a thermal transfer method, an electronic photo method and the like can obtain the effect. Also, a photosensitizing agent may be applied before printing in a printing apparatus in a silver-halide photography method.

(Other Preferred Embodiments)

In the above embodiment, a control form to make the applying amount constant by controlling the circulation speed was described, but application of the present invention is not limited to this form. For example, if there is a mode that a larger amount of applying liquid than usual amount is preferable, the pump may be driven so that the circulation speed of the applying liquid in the liquid holding space is slowed in that mode. Conversely, if smaller amount of applying liquid than usual amount is preferable, the pump may be driven so that the circulation speed is increased.

As described above, the applying amount can be changed by changing the circulation speed or pressure in the liquid holding space. Therefore, the above described embodiments change the circulation speed or the pressure in the liquid holding space to control the applying amount. However, control method of the applying amount according to the present invention is not limited to the above methods. For example, the applying amount can be changed by changing rotating speed of the applying roller, as shown in FIG. 18. Accordingly, the applying amount may be controlled by changing rotating speed of the applying roller, instead of changing the circulation speed. In this case, when it is need to increase the applying amount of the applying liquid, the control is made to increase the rotating speed of the applying roller. Conversely, when it is need to decrease the applying amount of the applying liquid, the control is made to lower the rotating speed of the applying roller.

The present invention may include an embodiment in which the rotational speed of the applying roller is changed in accordance with temperature to maintain the applying amount constant. More specifically, the applying amount can be changed by temperature change, as shown in FIGS. 16 and 17. Accordingly, for controlling the applying amount to be constant regardless of the temperature, the control may be made to change the rotational speed of the applying roller according to the temperature.

Furthermore, as described above, when the contact force between the liquid holding member and the applying roller varies, the amount of the applying liquid going out of the liquid holding space. As a result, the applying amount varies. Therefore, the present invention may include a configuration that controls the applying amount of the applying liquid by employing a change in the contact force between the liquid holding member and the applying roller. For example, when it is need to increase the applying amount of the applying liquid, the control is made to decrease the contact force, and when it is need to decrease the applying amount of the applying liquid, the control is made to increase the contact force. In this manner, the present invention includes the control method as an embodiment which controls the applying amount by changing the contact force between the liquid holding member and the applying roller. In this case, it is no need to change the circulation speed and the rotational speed of the applying roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A liquid applying apparatus comprising:

a liquid applying unit that includes an applying member for applying a liquid to a medium and a liquid holding member which contacts with said applying member to form a liquid holding space for holding the liquid in the liquid holding space, and that moves said applying member relatively to the medium to apply the liquid in the liquid holding space to the medium through said applying member;

a storage portion for storing the liquid;

a supply path for supplying the liquid from said storage portion to the liquid holding space;

a recovery path for recovering the liquid from the liquid holding space to said storage portion;

a circulation system having a pump provided at said recovery path to circulate the liquid in a flow path including said storage portion, said supply path, the liquid holding space and said recovery path during an applying operation of the liquid by said liquid applying unit, wherein a pump is not provided at said supply path; and a control unit that controls said circulation system to change a negative pressure in the liquid holding space which relates to a circulation speed of the liquid circulated by said circulation system so as to control an amount of the liquid applied by said liquid applying unit.

2. A liquid applying apparatus as claimed in claim 1, wherein said control unit controls the amount of the applied liquid according to a value of a parameter relating to a viscosity change in the liquid.

3. A liquid applying apparatus as claimed in claim 1, wherein said control unit controls the amount of the applied liquid according to a type of the medium.

4. A liquid applying apparatus as claimed in claim 1, wherein said applying member comprises an applying roller and the moving of said applying member comprises rotation of said applying roller.

5. A liquid applying apparatus as claimed in claim 1, wherein said liquid holding member comprises a supply port connected to said supply path and a recovery port connected to said recovery path, said liquid supply port is formed in a vicinity of one end portion of the liquid holding space in a longitudinal direction of the liquid holding space, and said liquid recovery port is provided in a vicinity of the other end portion of the liquid holding space in the longitudinal direction.

6. An ink jet printing apparatus comprising:

a liquid applying apparatus as claimed in claim 1; and a print unit for printing an image on the medium by ejecting ink to the medium, to which the liquid is applied by said liquid applying apparatus.

* * * * *